US008938989B2

(12) United States Patent
Katoh

(10) Patent No.: US 8,938,989 B2
(45) Date of Patent: Jan. 27, 2015

(54) HEAT EXCHANGER

(75) Inventor: Yoshiki Katoh, Chita-gun (JP)

(73) Assignee: Denso Corporation, Kariya (JP)

( * ) Notice: Subject to any disclaimer, the term of this patent is extended or adjusted under 35 U.S.C. 154(b) by 307 days.

(21) Appl. No.: 13/699,518

(22) PCT Filed: Jun. 17, 2011

(86) PCT No.: PCT/JP2011/003468

§ 371 (c)(1),
(2), (4) Date: Nov. 21, 2012

(87) PCT Pub. No.: WO2011/161918

PCT Pub. Date: Dec. 29, 2011

(65) Prior Publication Data

US 2013/0061631 A1 Mar. 14, 2013

(30) Foreign Application Priority Data

Jun. 25, 2010 (JP) ..... 2010-145011

(51) Int. Cl.
*F25B 39/02* (2006.01)
*F28D 1/04* (2006.01)
*F28D 1/053* (2006.01)
(Continued)

(52) U.S. Cl.
CPC ..... *F28D 1/0426* (2013.01); *F28D 1/05391* (2013.01); *F28F 9/02* (2013.01); *F28D 2021/0084* (2013.01); *F28D 2021/0094* (2013.01)
USPC ..... 62/515; 62/525

(58) Field of Classification Search
USPC ..... 62/515, 525; 165/104.26, 140, 157, 175
See application file for complete search history.

(56) References Cited

U.S. PATENT DOCUMENTS 6,397,938 B1 * 6/2002 Nishishita ..... 165/153
6,666,265 B1 * 12/2003 Kato et al. ..... 165/177
(Continued)

FOREIGN PATENT DOCUMENTS

DE 102007054703 A1 5/2009
JP 3-30068 U 3/1991
(Continued)

OTHER PUBLICATIONS

Office action dated Jun. 4, 2013 in corresponding Japanese Application No. 2010-145011.
(Continued)

*Primary Examiner* — Melvin Jones
(74) *Attorney, Agent, or Firm* — Harness, Dickey & Pierce, PLC

(57) ABSTRACT

A heat exchanger includes refrigerant tubes through which refrigerant flows, and cooling-medium tubes through which coolant of a vehicle-running electric motor flows. The refrigerant tubes and the cooling-medium tubes are alternately lamination-arranged. The heat exchanger further includes outside air passages between the refrigerant tubes and the cooling-medium tubes which are adjacent to each other, and outside air flows through the outside air passages. The heat exchanger further includes outer fins arranged in the outside air passages to be capable of transferring heat between the refrigerant tubes and the cooling-medium tubes. Accordingly, appropriate heat exchange can be performed between the refrigerant and the outside air, between the coolant and the outside air, and between the refrigerant and the coolant.

7 Claims, 13 Drawing Sheets

HEATING OPERATION

(51) Int. Cl.
*F28F 9/02* (2006.01)
*F28D 21/00* (2006.01)

(56) References Cited

U.S. PATENT DOCUMENTS

| | | | | |
|---|---|---|---|---|
| 2005/0039893 | A1* | 2/2005 | Nobuta et al. | 165/132 |
| 2008/0072614 | A1* | 3/2008 | Bhatti et al. | 62/305 |
| 2008/0115528 | A1* | 5/2008 | Yamamoto et al. | 62/513 |
| 2009/0090130 | A1* | 4/2009 | Aung et al. | 62/525 |
| 2009/0241573 | A1* | 10/2009 | Ikegami et al. | 62/238.7 |

FOREIGN PATENT DOCUMENTS

| | | | |
|---|---|---|---|
| JP | 4-33860 | U | 3/1992 |
| JP | 11-157326 | A | 6/1999 |
| JP | 2004-205056 | A | 7/2004 |
| JP | 2007-155268 | A | 6/2007 |

OTHER PUBLICATIONS

International Search Report and Written Opinion of the ISA for PCT/JP2011/003468, ISA/JP, mailed Aug. 9, 2011.

* cited by examiner

WASTE-HEAT RECOVERY OPERATION (a)

(b)

HEAT EXCHANGER

CROSS-REFERENCE TO RELATED APPLICATIONS

This application is a 371 U.S. National Stage of International Application No. PCT/JP2011/003468, filed Jun. 17, 2011, which is based on and claims priority to Japanese Patent Application No. 2010-145011, filed on Jun. 25, 2010. The disclosures of the above applications are incorporated herein by reference.

TECHNICAL FIELD

The present invention relates to a combined heat exchanger configured to be capable of performing heat exchange among three kinds of fluids.

BACKGROUND ART

Conventionally, a combined heat exchanger is known, which is configured to be capable of performing heat exchange among three kinds of fluids. For example, in Patent Document 1, a heat exchanger is disclosed, which is configured to be capable of performing heat exchange between refrigerant of a refrigeration cycle device and outdoor air (outside air), and performing heat exchange between the refrigerant and coolant that cools an engine.

Specifically, the heat exchanger of Patent Document 1 includes multiple refrigerant tubes that are lamination-arranged, and both end portions of the refrigerant tubes are connected to refrigerant tanks that collect and distribute refrigerant. The heat exchanger further includes heat pipes arranged between the lamination-arranged refrigerant tubes, and one end portions of the heat pipes are connected to a coolant tank through which coolant flows. Further, heat-exchange promoting fins are arranged in air passages provided between the refrigerant tubes and the heat pipes.

When the refrigeration cycle device is operated, refrigerant evaporates by absorbing heat of outside air and heat of coolant (i.e., waste heat of the engine), and frost formation in the heat exchanger is limited by using the waste heat of the engine transmitted through the heat pipes as a heat source.

PRIOR ART DOCUMENT

Patent Document

Patent Document 1: JP 11-157326 A

Recently, an eco-run vehicle is rapidly spreading, which is designed to protect the environment and to improve fuel efficiency. Waste heat generated from an engine of the eco-run vehicle is small as compared to that generated from a general gasoline-engine vehicle or the like.

For example, in a hybrid vehicle that includes an engine and an electric motor as power sources for vehicle running, waste heat of the engine may not be obtained, and a temperature of coolant may not be increased sufficiently in a running mode in which the engine is stopped and the hybrid vehicle runs on driving force outputted only from the electric motor.

When the temperature of coolant cannot be increased sufficiently by using waste heat of the engine in the heat exchanger of Patent Document 1 where the heat pipes are used, the heat pipes cannot be used appropriately. Accordingly, heat absorption by the refrigerant from waste heat of the engine cannot be performed, and frost formation in the heat exchanger cannot be limited.

Additionally, in the heat exchanger of Patent Document 1, the heat pipes are curved in a flow direction of outside air, and are connected to the coolant tank in order to arrange the heat pipes between the lamination-arranged tubes. Therefore, there is also a problem that the heat exchanger is complicated in configuration and is large in size.

SUMMARY OF THE INVENTION

In consideration of the above-described points, it is an objective of the present invention to provide a heat exchanger that is capable of performing appropriate heat exchange among three kinds of fluids.

To achieve the above-described objective, a heat exchanger of a first example of the invention includes a first heat-exchange portion and a second heat-exchange portion. The first heat-exchange portion includes a plurality of first tubes through which a first fluid flows to exchange heat with a third fluid flowing around the first tubes, and a first tank part extending in a lamination direction of the first tubes to collect the first fluid from the first tubes and to distribute the first fluid to the first tubes. The second heat-exchange portion includes a plurality of second tubes through which a second fluid flows to exchange heat with the third fluid flowing around the second tubes, and a second tank part extending in a lamination direction of the second tubes to collect the second fluid from the second tubes and to distribute the second fluid to the second tubes. At least one of the plurality of first tubes is arranged between the second tubes, and at least one of the plurality of second tubes is arranged between the first tubes. The first tubes and the second tubes define therebetween spaces that include third fluid passages through which the third fluid flows. The third fluid passages accommodate therein outer fins that are capable of promoting the heat exchanges performed in the first and second heat-exchange portions and are capable of transferring heat between the first fluid flowing through the first tubes and the second fluid flowing through the second tubes. Both the first tubes and the second tubes are fixed to the first tank part, and both the first tubes and the second tubes are fixed to the second tank part.

In this case, the first fluid and the third fluid are capable of exchanging heat with each other appropriately via the first tubes and the outer fins. The second fluid and the third fluid are capable of exchanging heat with each other appropriately via the second tubes and the outer fins. Furthermore, the first fluid and the second fluid are capable of exchanging heat with each other appropriately via the outer fins.

Hence, heat exchanges can be appropriately performed among the three kinds of fluids. Moreover, for example, by using the heat exchanger of the invention for a system capable of adjusting flow amounts of the first to third fluids, amounts of heat exchanges among the three kinds of fluids can be adjusted as required, and heat exchanges can be thereby performed among the three kinds of fluids further appropriately.

Additionally, both the first tubes and the second tubes are fixed to the first tank part, and both the first tubes and the second tubes are fixed to the second tank part. Therefore, complication in configuration and increasing in size of the heat exchanger can be limited.

In other words, both the first tubes and the second tubes can be formed into shapes similar to each other because both the first tubes and the second tubes are fixed to the first tank part, which is necessary for distributing and collecting the first fluid to and from the first tubes, and are fixed to the second tank part, which is necessary for distributing and collecting the second fluid to and from the second tubes.

Consequently, either of the first tubes or the second tubes is not required to be curved as not in the conventional technology. Hence, complication in configuration and increasing in size of the heat exchanger can be limited as a whole. As a result, the heat exchanger can be provided, which has a simple configuration and can perform appropriate heat exchanges among the three kinds of fluids.

Here, the word "fixed" means a state where the first and second tubes and the first and second tank parts are not displaced relatively to each other, and thereby is not limited to a meaning in which the first and second tubes are joined to the first and second tank parts.

The first tank part may include a first fixing plate member to which at least either of the first tubes or the second tubes is fixed, a first middle plate member fixed to the first fixing plate member, and a first tank forming member that is fixed to the first fixing plate member or the first middle plate member, and has therein a space into which the first fluid is collected or from which the first fluid is distributed. The second tank part may include a second fixing plate member to which at least either of the first tubes or the second tubes is fixed, a second middle plate member fixed to the second fixing plate member, and a second tank forming member fixed to the second fixing plate member or the second middle plate member, and has therein a space into which the second fluid is collected or from which the second fluid is distributed. The first middle plate member may have first communication holes through which the first tubes communicate with the space provided inside the first tank forming member, and the second middle plate member may have second communication holes through which the second tubes communicate with the space provided inside the second tank forming member.

In this case, even when the first and second tubes are fixed to the first and second tank parts, it can be achieved easily and certainly that the first tank part functions to distribute and collect the first fluid to and from the first tubes, and that the second tank part functions to distribute and collect the second fluid to and from the second tubes.

The first tubes may extend through the first communication holes to protrude into the space provided inside the first tank forming member, and the second tubes may extend through the second communication holes to protrude into the space provided inside the second tank forming member.

In this case, the first tubes can be made to communicate with the space provided inside the first tank forming member certainly, and the second tubes can be made to communicate with the space provided inside the second tank forming member certainly. Outer periphery portions of the first tubes may be fixed to inner periphery portions of the first communication holes by joining or the like, and outer periphery portions of the second tubes may be fixed to inner periphery portions of the second communication holes by joining or the like.

The first tubes and the second tubes may be arranged in a plurality of rows with respect to a flow direction of the third fluid flowing through the third fluid passages. The first fixing plate member and the first middle plate member may define therebetween first communication spaces through which the second tubes arranged with respect to the flow direction of the third fluid communicate with each other. The second fixing plate member and the second middle plate member may define therebetween second communication spaces through which the first tubes arranged with respect to the flow direction of the third fluid communicate with each other.

In this case, the first communication spaces can be provided inside the first tank part as flow passages through which the second fluid flowing out of the second tubes fixed to the first tank part passes, and the second communication spaces can be provided inside the second tank part as flow passages through which the first fluid flowing out of the first tubes fixed to the second tank part passes. Therefore, even when the first tubes and the second tubes of the heat exchanger are arranged in the plurality of rows with respect to a flow direction of the third fluid, increasing in size of the heat exchanger can be limited as a whole.

The first and second tubes may be fixed to the first and second fixing plate members by brazing. Accordingly, the first and second tubes can be fixed to the first and second fixing plate members readily.

The first fixing plate member may be fixed to the first tank forming member by crimping, and the second fixing plate member may be fixed to the second tank forming member by crimping. Accordingly, the first fixing plate member can be fixed to the first tank forming member easily, and the second fixing plate member can be fixed to the second tank forming member easily.

The heat exchanger may be used as an evaporator of a vapor-compression refrigeration cycle, in which refrigerant evaporates. In this case, the first fluid is the refrigerant of the refrigeration cycle, the second fluid is heat medium having absorbed heat of an external heat source, and the third fluid is air.

In this case, even if the evaporator (heat exchanger) is frosted when the refrigerant that is the first fluid absorbs heat to evaporate, the frosted evaporator can be defrosted by using heat of the heat medium that is the second fluid.

The heat exchanger may be used as a radiator of a vapor-compression refrigeration cycle, in which refrigerant radiates heat. In this case, the first fluid is the refrigerant of the refrigeration cycle, the second fluid is heat medium having absorbed heat of an external heat source, and the third fluid is air.

In this case, the air can be heated by heat of the refrigerant that is discharged from a compressor by activating the refrigeration cycle. The air can be heated also by heat of the heat medium.

The heat exchanger may be used for a vehicle cooling system. In this case, the first fluid is a heat medium having absorbed heat of a first in-vehicle device that generates heat in its operation state, the second fluid is a heat medium having absorbed heat of a second in-vehicle device that generates heat in its operation state, and the third fluid is air.

Here, a vehicle has various in-vehicle devices that generate heat in operation states thereof. Heat amounts generated from the in-vehicle devices respectively changes depending on a running state (running load) of the vehicle. Thus, a heat amount generated from an in-vehicle device that has a large heat-generation capacity can be transferred not only to the air but also to an in-vehicle device that has a small heat-generation capacity. The in-vehicle devices that generate heat in operation states thereof include an internal combustion engine, a vehicle-running electric motor, an inverter, and an electric device, for example.

Figure 1:
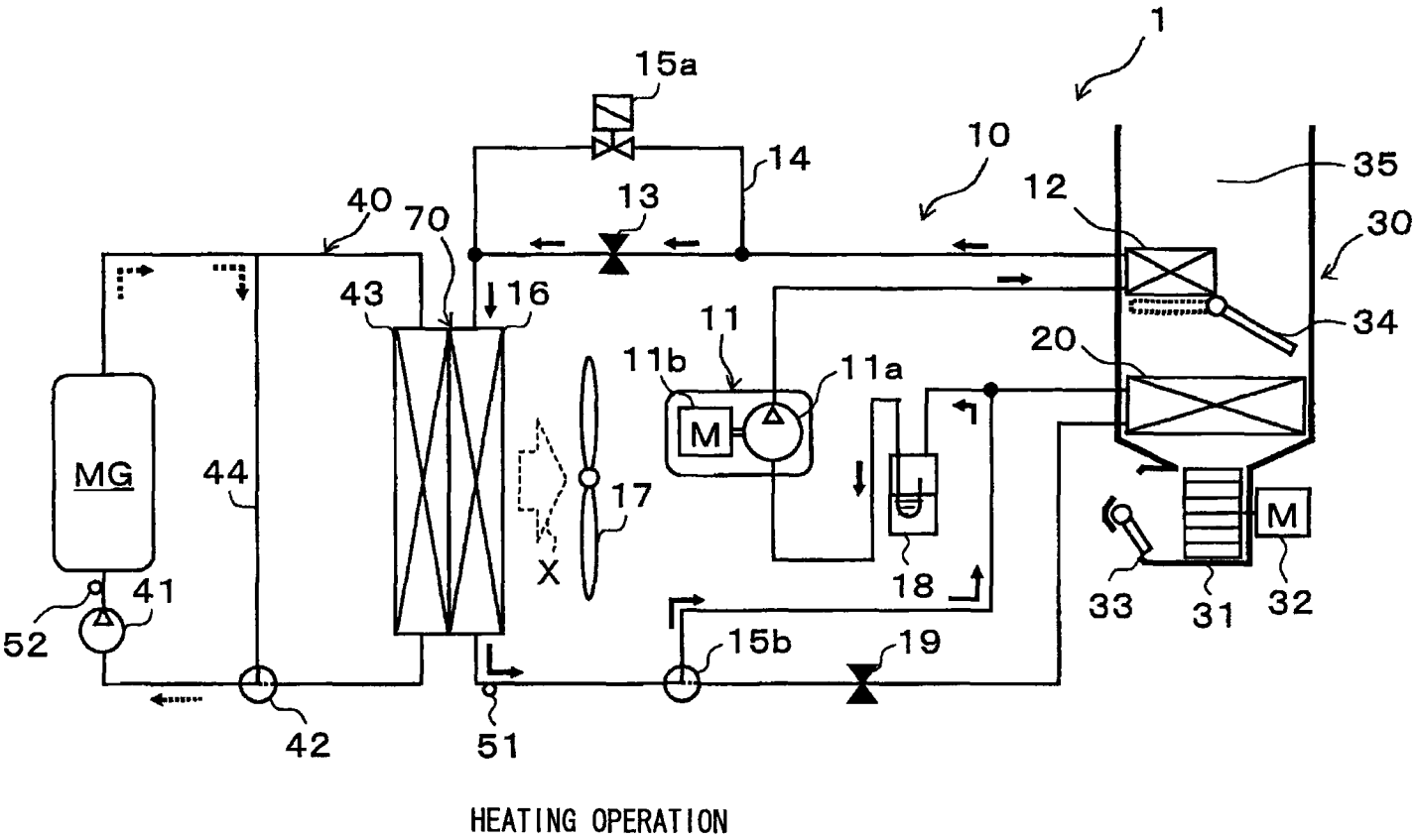
FIG. 1 is an entire configuration diagram showing a refrigerant flow passage in a heating operation of a heat pump cycle, according to a first embodiment.

EMBODIMENTS FOR EXPLOITATION OF THE INVENTION (First Embodiment)

A first embodiment of the invention will be described with reference to FIGS. 1 to 8. In the present embodiment, a heat exchanger 70 of the invention is used for a heat pump cycle 10 in a vehicle air conditioner 1 which regulates a temperature of air blown into a vehicle compartment. FIGS. 1 to 4 are entire configuration diagrams of the vehicle air conditioner 1 of the present embodiment. The vehicle air conditioner 1 is used for a hybrid vehicle in which driving force for vehicle running is obtained from an internal combustion (engine) and a vehicle-running electric motor MG.

The hybrid vehicle is capable of switching its running state by operating or stopping the engine depending on a running load or the like of the vehicle. The running state includes a state, in which the driving force is obtained from both the engine and the vehicle-running electric motor MG, and a state, in which the driving force is obtained only from the vehicle-running electric motor MG by stopping the engine. Accordingly, in the hybrid vehicle, fuel efficiency of the vehicle can be improved more than that of a general vehicle in which driving force for vehicle running is obtained only from an engine.

The heat pump cycle 10 in the vehicle air conditioner 1 is a vapor-compression refrigeration cycle which functions to heat or cool air blown into the vehicle compartment. The blown air is a heat-exchange target fluid, and the vehicle compartment is an air-conditioning target space. That is, the heat pump cycle 10 is capable of performing a heating operation (air heating operation) and a cooling operation (air cooling operation) by switching a refrigerant flow passage of the heat pump cycle 10. Air that is to be blown into the vehicle compartment is heated to heat an inside of the vehicle compartment in the heating operation, and is cooled to cool the inside of the vehicle compartment in the cooling operation.

Moreover, the heat pump cycle 10 is capable of performing a defrosting operation and a waste-heat recovery operation. In the defrosting operation, frost is melted, which has been formed on an exterior heat-exchange portion 16 of the later-described combined heat exchanger 70 that functions as a refrigerant evaporator in the heating operation. In the waste-heat recovery operation, refrigerant absorbs heat generated from the vehicle-running electric motor MG that is used as an outer heat source in the heating operation. In the entire configuration diagrams shown in FIGS. 1 to 4, a flow of refrigerant in the heat pump cycle 10 in each operation is shown by solid arrows.

In the heat pump cycle 10 of the present embodiment, general fluorocarbon refrigerant is adopted as refrigerant, and the heat pump cycle 10 is configured to be a subcritical cycle in which a high-pressure side refrigerant pressure does not exceed a critical pressure thereof. Refrigerant oil is mixed with the refrigerant in order to lubricate a compressor 11, and a part of the refrigerant oil circulates in the heat pump cycle 10 with the refrigerant.

The compressor 11 is disposed inside an engine compartment, and draws and compresses refrigerant to discharge the compressed refrigerant in the heat pump cycle 10. The compressor 11 is an electric compressor in which an electric motor 11*b* drives a fixed-displacement compressor 11*a* having a fixed discharge capacity. Various compression mechanisms, such as a scroll-type compression mechanism and a vane-type compression mechanism, may be adopted as the fixed-displacement compressor 11*a*.

An operation (rotation number) of the electric motor 11*b* is controlled by a control signal output from a later-described air conditioning controller, and an alternating-current motor or a direct-current motor may be adopted as the electric motor 11*b*. The control of the rotation number causes a refrigerant discharge capacity of the compressor 11 to be changed. Hence, in the present embodiment, the electric motor 11*b* constitutes a discharge capacity changing device of the compressor 11.

A refrigerant outlet of the compressor 11 is connected to a refrigerant inlet side of an interior condenser 12 that is used as a using-side heat exchanger. The interior condenser 12 is arranged inside a casing 31 of an interior air-conditioning unit 30 of the vehicle air conditioner 1 to be used as a heating heat exchanger in which high-temperature and high-pressure refrigerant exchanges heat with air having passed through a later-described interior evaporator 20. A detailed configuration of the interior air-conditioning unit 30 will be described later.

The refrigerant outlet side of the interior condenser 12 is connected to a heating fixed throttle 13. The heating fixed throttle 13 is used as a decompression device for the heating operation, which decompresses and expands refrigerant flowing out of the interior condenser 12 in the heating operation. For example, an orifice and a capillary tube can be adopted as the heating fixed throttle 13. An outlet side of the heating fixed throttle 13 is connected to a refrigerant inlet side of the exterior heat-exchange portion 16 of the combined heat exchanger 70.

The refrigerant outlet side of the interior condenser 12 is connected to a fixed-throttle bypass passage 14 through which refrigerant flowing out of the interior condenser 12 bypasses the heating fixed throttle 13 to flow toward the exterior heat-exchange portion 16. In the fixed-throttle bypass passage 14, an open-close valve 15*a* is provided to open or close the fixed-throttle bypass passage 14. The open-close valve 15*a* is an electromagnetic valve in which an open-close operation of the open-dose valve 15*a* is controlled by a control voltage output from the air conditioning controller.

A pressure loss generated when refrigerant passes through the open-close valve 15*a* is extremely low relative to a pressure loss generated when refrigerant passes through the fixed throttle 13. When the open-close valve 15*a* is open, refrigerant flowing out of the interior condenser 12 flows into the exterior heat-exchange portion 16 through the fixed-throttle bypass passage 14. When the open-close valve 15*a* is closed, refrigerant flowing out of the interior condenser 12 flows into the exterior heat-exchange portion 16 through the heating fixed throttle 13.

Accordingly, the open-dose valve 15*a* is capable of switching the refrigerant flow passage of the heat pump cycle 10. Hence, the open-close valve 15*a* of the present embodiment functions as a refrigerant-flow-passage switching device. An electric three-way valve or the like may be adopted as the refrigerant-flow-passage switching device, which switches the refrigerant flow passage between a passage connecting from the outlet side of the interior condenser 12 to the inlet side of the heating fixed throttle 13 and a passage connecting from the outlet side of the interior condenser 12 to the inlet side of the fixed-throttle bypass passage 14.

The exterior heat-exchange portion 16 is a heat exchange portion in which low-pressure refrigerant flowing through an inside of the heat exchanger 70 exchanges heat with outside air blown by a blower fan 17. The exterior heat-exchange portion 16 is arranged inside the engine compartment. In the heating operation, the exterior heat-exchange portion 16 functions as an evaporation heat-exchange portion in which low-pressure refrigerant evaporates and exerts its heat-absorption effect. In the cooling operation, the exterior heat-exchange portion 16 functions as a heat-radiation heat-exchange portion in which high-pressure refrigerant radiates heat.

The blower fan 17 is an electric blower in which an operation rate, i.e., a rotation number (air blowing amount) is controlled by a control voltage output from the air conditioning controller. In the heat exchanger 70 of the present embodiment, the above-described exterior heat-exchange portion 16 is integrated with a later-described radiator portion 43 in which coolant that cools the vehicle-running electric motor MG exchanges heat with outside air blown by the blower fan 17.

Thus, the blower fan 17 of the present embodiment constitutes an exterior air-blowing device which blows outside air toward both the exterior heat-exchange portion 16 and the radiator portion 43. A detailed configuration of the combined heat exchanger 70, in which the exterior heat-exchange portion 16 and the radiator portion 43 are integrated, will be described later.

An outlet side of the exterior heat-exchange portion 16 is connected to an electric three-way valve 15*b*. An operation of the three-way valve 15*b* is controlled by a control voltage output from the air conditioning controller, and the three-way valve 15*b* constitutes the refrigerant-flow-passage switching device together with the above-described open-close valve 15*a*.

More specifically, the three-way valve 15*b* switches the refrigerant flow passage between a passage connecting from the outlet side of the exterior heat-exchange portion 16 to an inlet side of a later-described accumulator 18 and a passage connecting from the outlet side of the exterior heat-exchange portion 16 to an inlet side of a cooling fixed throttle 19.

The cooling fixed throttle 19 is a decompression device for cooling operation, which decompresses and expands refrigerant flowing out of the exterior heat-exchange portion 16 in the cooling operation. A basic structure of the cooling fixed throttle 19 is similar to that of the heating fixed throttle 13. An outlet side of the cooling fixed throttle 19 is connected to a refrigerant inlet side of the interior evaporator 20.

The interior evaporator 20 is arranged upstream of the interior condenser 12 in the air flow direction inside the casing 31 of the interior air-conditioning unit 30. The interior evaporator 20 is used as a cooling heat exchanger which cools air blown into the vehicle compartment through heat exchange with refrigerant flowing inside the interior evaporator 20. A refrigerant outlet side of the interior evaporator 20 is connected to the inlet side of the accumulator 18.

The accumulator 18 is a gas-liquid separator for low-pressure refrigerant, which separates refrigerant flowing thereinto into gas refrigerant and liquid refrigerant, and accumulates therein surplus refrigerant in the cycle 10. A gas-refrigerant outlet of the accumulator 18 is connected to a suction side of the compressor 11. Therefore, the accumulator 18 limits entering of liquid refrigerant into the compressor 11, and functions to prevent liquid compression by the compressor 11.

Next, the interior air-conditioning unit 30 will be described. The interior air-conditioning unit 30 is arranged inside an instrumental panel provided in a front part of the vehicle compartment. The casing 31 that is an outer shell of the interior air-conditioning unit 30 accommodates therein a blower 32, the above-described interior condenser 12 and the interior evaporator 20, for example.

The casing 31 is made of resin (e.g., polypropylene) which has a certain degree of elasticity and is superior in strength, and defines therein an air passage through which air is blown into the vehicle compartment. An inside-outside air switching device 33 is arranged at a most upstream side of the casing 31 in a flow direction of air in the casing 31. Outside air and air (inside air) inside the vehicle compartment are selectively introduced into the casing 31 through the inside-outside air switching device 33.

The inside-outside air switching device 33 has an inside-air introduction port through which inside air is introduced into the casing 31, and an outside-air introduction port through which outside air is introduced into the casing 31. The inside-outside air switching device 33 further includes therein an inside-outside air switching door, which continuously adjusts opening areas of the inside-air introduction port and the outside-air introduction port to change a ratio between a flow amount of the inside air and a flow amount of the outside air.

The blower 32 is arranged downstream of the inside-outside air switching device 33 in the air flow direction to blow air drawn via the inside-outside air switching device 33 toward the inside of the vehicle compartment. The blower 32 is an electric blower in which a centrifugal multi-blade fan (sirocco fan) is driven by an electric motor. A rotation number (air blowing amount) of the blower 32 is controlled by a control voltage output from the air conditioning controller.

The interior evaporator 20 and the interior condenser 12 are arranged downstream of the blower 32 in the air flow direction in this order. In other words, the interior evaporator 20 is arranged upstream of the interior condenser 12 in the air flow direction.

Additionally, an air mix door 34 is arranged downstream of the interior evaporator 20 and upstream of the interior condenser 12 in the air flow direction. The air mix door 34 adjusts a ratio of a flow amount of air passing through the interior condenser 12 to a flow amount of air passing through the interior evaporator 20. A mixing space 35 is provided downstream of the interior condenser 12 in the air flow direction, where air heated via heat exchange with refrigerant in the interior condenser 12 is mixed with non-heated air having bypassed the interior condenser 12.

The casing 31 has air outlets provided in a most downstream part of the casing 31 in the air flow direction, through which conditioned air mixed in the mixing space 35 is blown into the vehicle compartment that is a target cooling space or the like. The air outlets include a face air outlet through which conditioned air is blown toward an upper part of a passenger in the vehicle compartment, a foot air outlet through which conditioned air is blown toward a foot area of the passenger, and a defroster air outlet through which conditioned air is blown toward an inner surface of a windshield of the vehicle. (These air outlets are not shown.)

The air mix door 34 adjusts the ratio of the flow amount of air passing through the interior condenser 12, so that a temperature of conditioned air mixed in the mixing space 35 is adjusted. That is, a temperature of air to be blown through each air outlet is adjusted. Thus, the air mix door 34 is used as a temperature adjusting device which adjusts a temperature of conditioned air blown into the vehicle compartment.

In other words, the air mix door 34 functions also as a heat-exchange amount adjusting device which adjusts a heat exchange amount of the interior condenser 12 used as the using-side heat exchanger where refrigerant discharged from the compressor 11 exchanges heat with air blown into the vehicle compartment. The air mix door 34 is driven by a non-shown servomotor in which an operation of the servomotor is controlled by a control signal output from the air conditioning controller.

Moreover, a face door, a foot door and a defroster door (not shown) are provided respectively at upstream sides of the face air outlet, the foot air outlet and the defroster air outlet to adjust opening areas of these three air outlets respectively.

These face door, foot door and defroster door are used as an outlet-mode switching device which switches an air outlet mode, and are driven by a servomotor via a link mechanism or the like. An operation of the servomotor is controlled by a control signal output from the air conditioning controller.

Next, a coolant circulation circuit 40 will be described. The coolant circulation circuit 40 is a cooling-medium circulation circuit through which a coolant (e.g., ethylene glycol aqueous) circulates as a cooling medium (heat medium). A coolant passage is provided in the above-described vehicle-running electric motor MG that is one of an in-vehicle device radiating heat in its operation state. When the coolant passes through the coolant passage of the vehicle-running electric motor MG, the vehicle-running electric motor MG is cooled.

The coolant circulation circuit 40 includes a coolant pump 41, an electric three-way valve 42, the radiator portion 43 of the combined heat exchanger 70, and a bypass passage 44 through which the coolant bypasses the radiator portion 43.

The coolant pump 41 is an electric pump that discharges coolant to the coolant passage provided in the vehicle-running electric motor MG in the coolant circulation circuit 40, and a rotation number (flow amount) of the coolant pump 41 is controlled by a control signal output from the air conditioning controller. Therefore, the coolant pump 41 functions as a cooling capacity adjusting portion which adjusts a cooling capacity by changing a flow amount of the coolant that cools the vehicle-running electric motor MG.

The three-way valve 42 switches a cooling medium circuit between a circuit, in which an inlet side of the coolant pump 41 is connected to an outlet side of the radiator portion 43 so that the coolant flows into the radiator portion 43, and a circuit, in which the inlet side of the coolant pump 41 is connected to an outlet side of the bypass passage 44 so that the coolant bypasses the radiator portion 43. An operation of the three-way valve 42 is controlled by a control voltage output from the air conditioning controller, and the three-way valve 42 is used as a circuit switching device which switches the cooling medium circuit.

In the coolant circulation circuit 40 of the present embodiment, as shown by dash arrows in FIGS. 1 to 4, the cooling medium circuit can be switched between a circuit, in which the coolant flows in an order of the coolant pump 41→the vehicle-running electric motor MG→the radiator portion 43→the coolant pump 41, and a circuit, in which the coolant flows in an order of the coolant pump 41→the vehicle-running electric motor MG the bypass passage 44→the coolant pump 41.

When the three-way valve 42 selects the cooling medium circuit in which the coolant bypasses the radiator portion 43 in an operation state of the vehicle-running electric motor MG, the coolant increases in temperature without radiating heat in the radiator portion 43. In other words, when the three-way valve 42 selects the cooling medium circuit in which the coolant bypasses the radiator portion 43, heat (radiation heat) of the vehicle-running electric motor MG is accumulated in the coolant.

The radiator portion 43 is arranged in the engine compartment to function as the heat-radiation heat-exchange portion in which the coolant exchanges heat with outside air blown by the blower fan 17. As described above, the radiator portion 43 is integrated with the exterior heat-exchange portion 16 in the combined heat exchanger 70.

Figure 5:
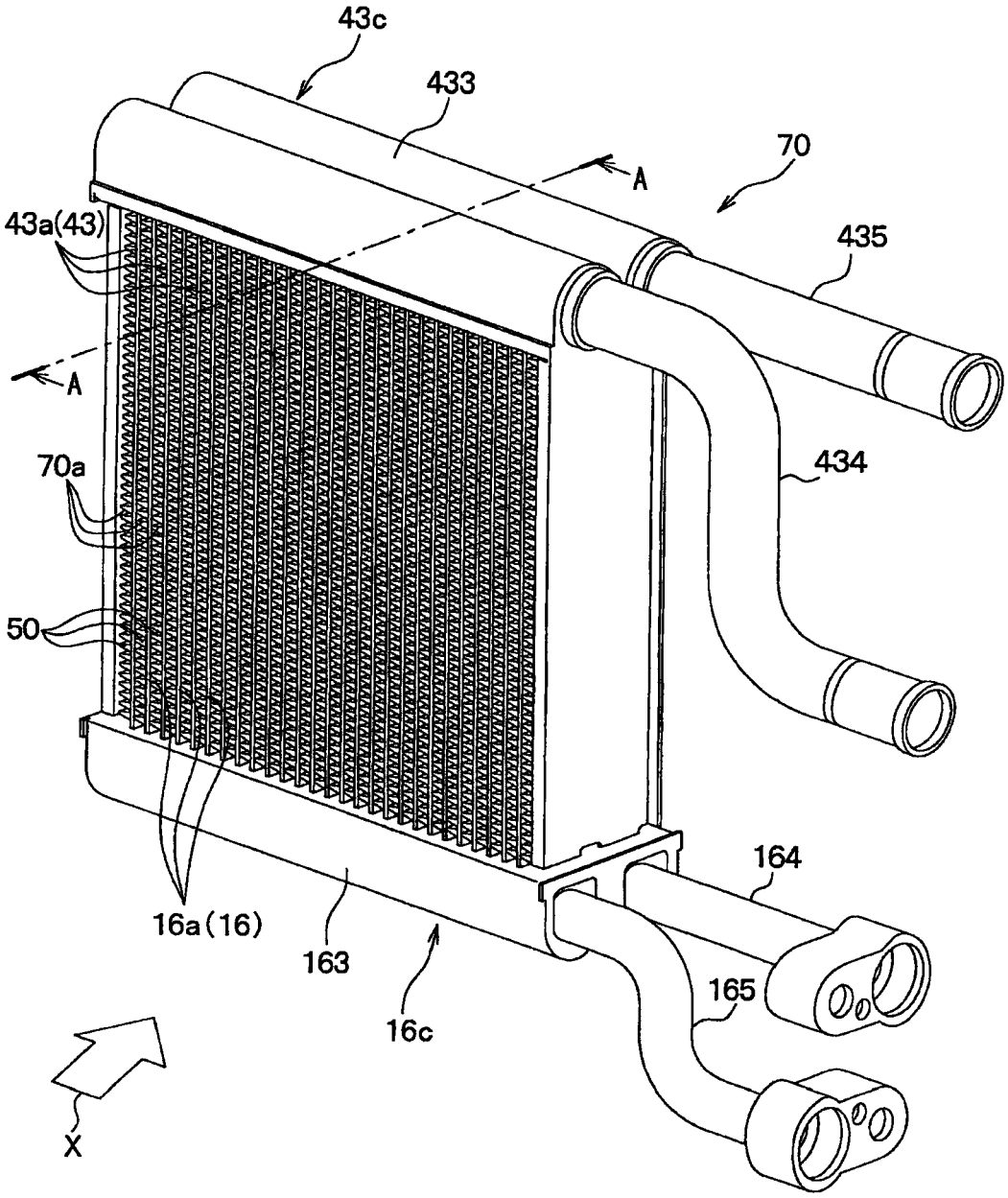
FIG. 5 is a perspective view showing a heat exchanger according to the first embodiment.
Figure 6:
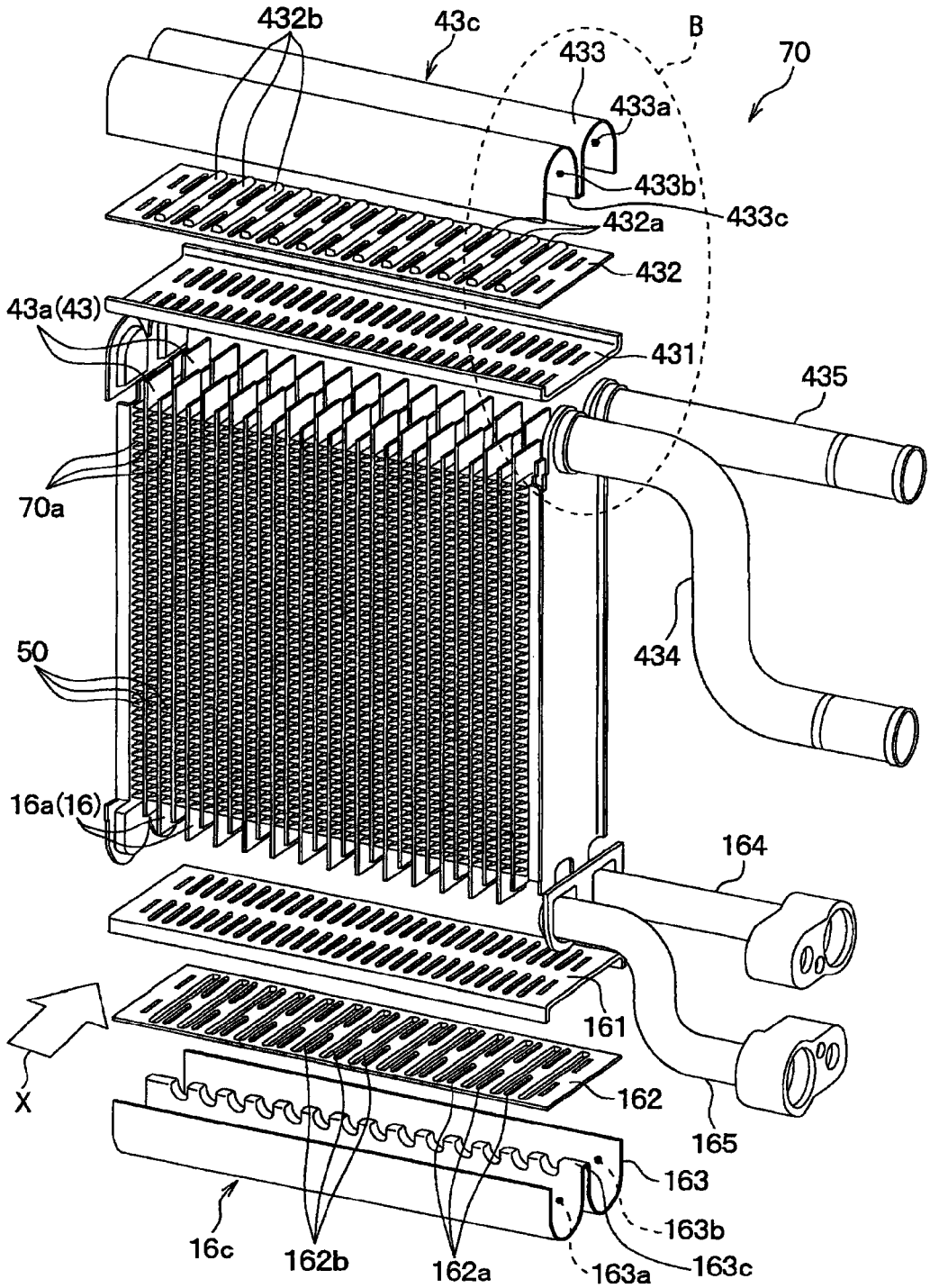
FIG. 6 is an exploded view showing the heat exchanger according to the first embodiment.
Figure 7:
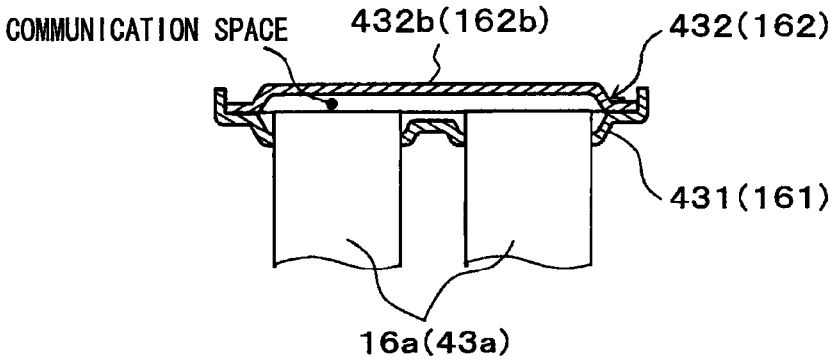
FIG. 7 is a sectional view taken from a line A-A in FIG. 5.
Figure 8:
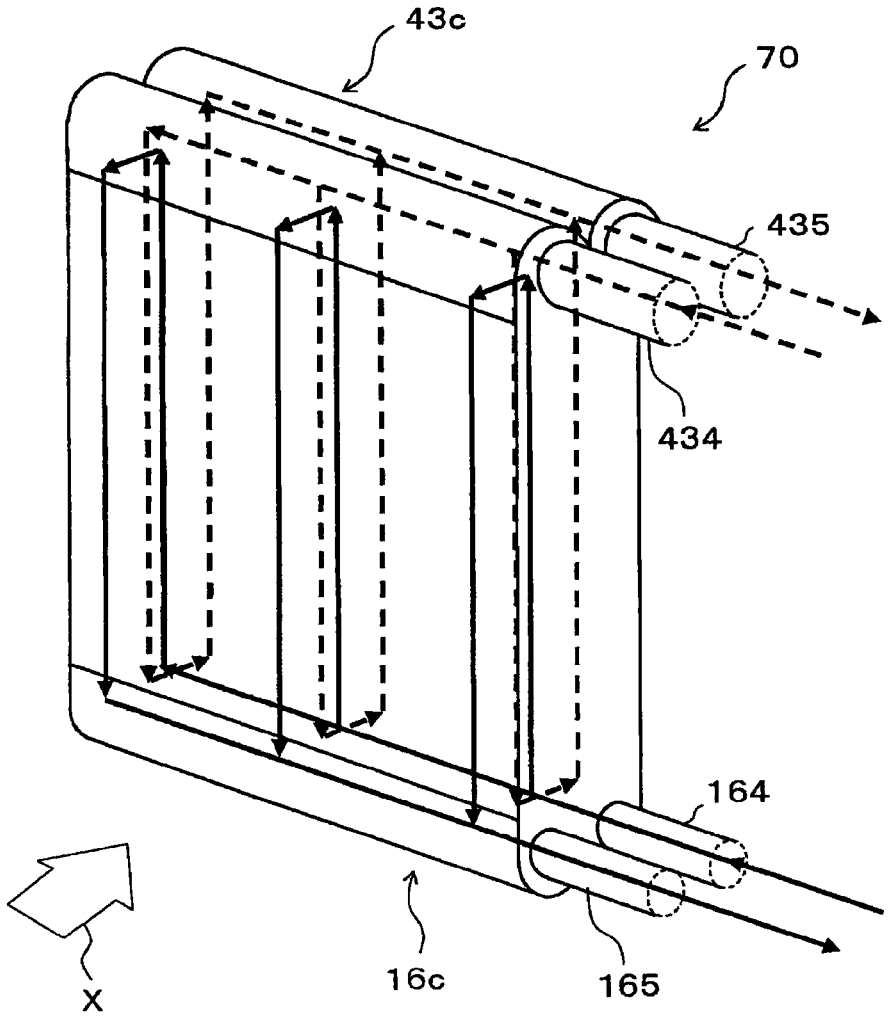
FIG. 8 is a schematic perspective diagram showing a flow of refrigerant and a flow of coolant in the heat exchanger according to the first embodiment.

A detailed configuration of the combined heat exchanger 70 of the present embodiment will be described referring to FIGS. 5 to 8. FIG. 5 is a perspective view showing the heat exchanger 70 of the present embodiment, and FIG. 6 is an exploded view showing the heat exchanger 70. FIG. 7 is a sectional view taken along a line A-A in FIG. 5, and FIG. 8 is a schematic perspective diagram for explanation of flows of refrigerant and the coolant in the heat exchanger 70.

As shown in FIGS. 5 and 6, the exterior heat-exchange portion 16 and the radiator portion 43 respectively include multiple tubes through which the refrigerant or the coolant passes, and a pair of collection-distribution tanks which are arranged respectively at both end sides of the multiple tubes to collect the refrigerant or the coolant from the tubes and to distribute the refrigerant or the coolant to the tubes. In other words, the exterior heat-exchange portion 16 and the radiator portion 43 have a configuration of a tank-and-tube type heat exchanger.

More specifically, the exterior heat-exchange portion 16 includes multiple refrigerant tubes 16*a* through which refrigerant flows as a first fluid, and a refrigerant tank part 16*c* which extends in a lamination direction of the multiple refrigerant tubes 16*a* to collect refrigerant from the refrigerant tubes 16*a* and to distribute refrigerant to the refrigerant tubes 16*a*. In the exterior heat-exchange portion 16, refrigerant passing through the refrigerant tubes 16*a* exchanges heat with air (outside air blown by the blower fan 17) that flows around the refrigerant tubes 16*a* as a third fluid.

The radiator portion 43 includes multiple cooling-medium tubes 43*a* through which the coolant flows as a second fluid, and a cooling-medium tank part 43*c* which extends in a lamination direction of the multiple cooling-medium tubes 43*a* to collect the coolant from the cooling-medium tubes 43*a* and to distribute the coolant to the cooling-medium tubes 43*a*. In the radiator portion 43, the coolant passing through the cooling-medium tubes 43*a* exchanges heat with air (outside air blown by the blower fan 17) that flows around the cooling-medium tubes 43*a*.

Both the refrigerant tubes 16*a* and the cooling-medium tubes 43*a* are flat tubes in which sectional surfaces perpendicular to a longitudinal direction thereof have flat shapes. As shown in the exploded view of FIG. 6, the refrigerant tubes 16*a* of the exterior heat-exchange portion 16 and the cooling-medium tubes 43*a* of the radiator portion 43 are respectively arranged in two rows with respect to a flow direction X of outside air blown by the blower fan 17.

Moreover, refrigerant tubes 16*a* and cooling-medium tubes 43*a*, which are arranged in an upwind side in the flow direction of outside air, are lamination-arranged alternately at predetermined intervals so that flat outer surfaces of adjacent tubes are opposed and parallel to each other. Similarly, refrigerant tubes 16*a* and cooling-medium tubes 43*a*, which are arranged in a downwind side in the flow direction of outside air, are also lamination-arranged alternately at predetermined intervals.

In other words, the refrigerant tubes 16*a* of the present embodiment are arranged between the cooling-medium tubes 43*a*, and the cooling-medium tubes 43*a* are arranged between the refrigerant tubes 16*a*. Spaces provided between the refrigerant tubes 16*a* and the cooling-medium tubes 43*a* are outside air passages 70*a* (third fluid passage) through which outside air blown by the blower fan 17 flows.

In the outside air passages 70*a*, outer fins 50 are arranged. The outer fins 50 promotes heat exchange between the refrigerant and outside air in the exterior heat-exchange portion 16, and promotes heat exchange between the coolant and outside air in the radiator portion 43. Moreover, heat can be transferred through the outer fins 50 between the refrigerant flowing through the refrigerant tubes 16*a* and the coolant flowing through the cooling-medium tubes 43*a*.

Corrugated fins are adopted as the outer fins 50, and the corrugated fins are obtained by bending highly heat-conductive metallic plates into wavelike shapes. In the present embodiment, the outer fins 50 are joined to both the refrigerant tubes 16*a* and the cooling-medium tubes 43*a*, and heat can be thereby transferred through the outer fins 50 between the refrigerant tubes 16*a* and the cooling-medium tubes 43*a*.

Next, the refrigerant tank part 16*c* and the cooling-medium tank part 43*c* are described below. Basic structures of these tank parts 16*c* and 43*c* are similar to each other. The refrigerant tank part 16*c* includes a refrigerant fixing plate member 161 to which both the refrigerant tubes 16*a* and the cooling-medium tubes 43*c* arranged in two rows are fixed, a refrigerant middle plate member 162 fixed to the refrigerant fixing plate member 161, and a refrigerant tank forming member 163.

The refrigerant middle plate member 162 has multiple recessed parts 162*b* as shown in the sectional view of FIG. 7, and multiple spaces are provided between the recessed parts 162*b* and the refrigerant fixing plate member 161 by fixing the refrigerant middle plate member 162 to the refrigerant fixing plate member 161. The multiple spaces communicate with the cooling-medium tubes 43*a*. The multiple spaces function as cooling-medium communication spaces through which the cooling-medium tubes 43*a* arranged in two rows with respect to the flow direction X of outside air communicate with each other.

In FIG. 7, a sectional surface around a recessed part 432*b* provided in a cooling-medium middle plate member 432 is shown for clarification of the drawing. As described above, because the basic structures of the refrigerant tank part 16*c* and the cooling-medium tank part 43*c* are similar to each other, a numeral is shown with a parenthesis with respect to the refrigerant fixing plate member 161, the recessed part 162*b* and the like.

The refrigerant middle plate member 162 has first communication holes 162*a* penetrating through the refrigerant middle plate member 162, and the first communication holes 162*a* are located at positions corresponding to those of the refrigerant tubes 16*a*. The refrigerant tubes 16*a* extend through the first communication holes 162*a*, and accordingly communicate with a space provided in the refrigerant tank forming member 163.

End portions of the refrigerant tubes 16*a* on the side of the refrigerant tank part 16*c* protrude toward the refrigerant tank part 16*c* more than end portions of the cooling-medium tubes 43*a* on the side of the refrigerant tank part 16*c* protrude. In other words, the end portions of the refrigerant tubes 16*a* on the side of the refrigerant tank part 16*c* and the end portions of the cooling-medium tubes 43*a* on the side of the refrigerant tank part 16*c* are not in alignment with each other.

When the refrigerant tank forming member 163 is fixed to the refrigerant fixing plate member 161 and the refrigerant middle plate member 162, a collection space 163*a* and a distribution space 163*b* are provided inside the refrigerant tank forming member 163. Refrigerant is distributed from the distribution space 163*b* to the refrigerant tubes 16*a*, and the refrigerant in the refrigerant tubes 16*a* is collected in the collections space 163*a*. Specifically, the refrigerant tank forming member 163 is formed of a metallic plate into a two-peak shape (W-shape) viewed in its longitudinal direction by press working.

The collection space 163*a* and the distribution space 163*b* are divided from each other by joining a center part 163*c* of the two-peak shape of the refrigerant tank forming member 163 to the refrigerant middle plate member 162. In the present embodiment, the collection space 163*a* is located on the upwind side in the flow direction X of outside air, and the distribution space 163*b* is located on the downwind side in the flow direction X of outside air.

The center part 163*c* is formed into a shape adapted to the recessed parts 162*b* provided in the refrigerant middle plate member 162. Hence, the collection space 163*a* and the distribution space 163*b* are defined so that refrigerant does not flow through a connection portion between the refrigerant middle plate member 162 and the refrigerant tank forming member 163.

As described above, the refrigerant tubes 16*a* extend through the first communication holes 162*a* of the refrigerant middle plate member 162 to protrude into one of the collection space 163*a* and the distribution space 163*b* that are provided inside the refrigerant tank forming member 163. The refrigerant tubes 16*a* arranged on the upwind side in the flow direction X of outside air communicate with the collection space 163*a*, and the refrigerant tubes 16*a* arranged on the downstream side in the flow direction X of outside air communicate with the distribution space 163*b*.

One end side of the refrigerant tank forming member 163 in its longitudinal direction is connected to a refrigerant inflow pipe 164, through which refrigerant flows into the distribution space 163*b*, and is connected to a refrigerant outflow pipe 165, through which refrigerant flows out of the collection space 163*a*. The other end side of the refrigerant tank forming member 163 in its longitudinal direction is closed with a closing member.

As shown in FIG. 6, the cooling-medium tank part 43*c* includes a cooling-medium fixing plate member 431, the cooling-medium middle plate member 432 fixed to the cooling-medium fixing plate member 431, and a cooling-medium tank forming member 433.

Refrigerant communication spaces are provided between the cooling-medium fixing plate member 431 and recessed parts 432*b* provided in the cooling-medium middle plate member 432. The refrigerant tubes 16*a* arranged in two rows with respect to the flow direction X of outside air communicate with each other through the refrigerant communication spaces.

The cooling-medium middle plate member 432 has second communication holes 432*a* penetrating through the cooling-medium middle plate member 432, and the second communication holes 432*a* are located at positions corresponding to positions of the cooling-medium tubes 43*a*. The cooling-medium tubes 43*a* extend through the second communication holes 432*a*, and accordingly communicate with a space provided in the cooling-medium tank forming member 433.

End portions of the cooling-medium tubes 43*a* on the side of the cooling-medium tank part 43*c* protrude toward the cooling-medium tank part 43*c* more than end portions of the refrigerant tubes 16*a* on the side of the cooling-medium tank part 43*c* protrude. In other words, the end portions of the cooling-medium tubes 43*a* on the side of the cooling-medium tank part 43*c* and the end portions of the refrigerant tubes 16*a* on the side of the cooling-medium tank part 43*c* are not in alignment with each other.

When the cooling-medium tank forming member 433 is fixed to the cooling-medium fixing plate member 431 and to the cooling-medium middle plate member 432, a collection space 433*a* for a cooling medium and a distribution space 163*b* for the cooling medium are provided inside the cooling-medium tank forming member 433. The collection space 433*a* and the distribution space 433*b* are divided from each other by a center part 433*c* of the cooling-medium tank forming member 433. In the present embodiment, the distribution space 433*b* is arranged on the upwind side in the flow direction X of outside air, and the collection space 433*a* is arranged on the downwind side in the flow direction X of outside air.

One end side of the cooling-medium tank forming member 433 in its longitudinal direction is connected to a cooling-medium inflow pipe 434, through which the cooling medium flows into the distribution space 433*b*, and is connected to a cooling-medium outflow pipe 435, through which the cooling medium flows out of the collection space 433*a*. The other end side of the cooling-medium tank forming member 433 in its longitudinal direction is closed with a closing member.

In the heat exchanger 70 of the present embodiment, as shown in a schematic perspective view of FIG. 8, refrigerant flows into the distribution space 163*b* of the refrigerant tank part 16*c* through the refrigerant inflow pipe 164, and then the refrigerant flows into the refrigerant tubes 16*a* arranged on the downwind side in the flow direction X of outside air.

The refrigerant flows out of the refrigerant tubes 16*a* arranged on the downwind side, and then flows into the refrigerant tubes 16*a* arranged on the upwind side in the flow direction X of outside air through the refrigerant communication spaces provided between the cooling-medium fixing plate member 431 and the cooling-medium middle plate member 432 of the cooling-medium tank part 43*c*.

As shown by solid arrows in FIG. 8, the refrigerant flows out of the refrigerant tubes 16*a* arranged on the upwind side, and then gathers in the collection space 163*a* of the refrigerant tank part 16*c* to flows out of the collection space 163*a* through the refrigerant outflow pipe 165. In the heat exchanger 70 of the present embodiment, the refrigerant flows through the refrigerant tubes 16*a* arranged on the downwind side→the refrigerant communication spaces of the cooling-medium tank part 43*c*→the refrigerant tubes 16*b* arranged on the upwind side, in this order, with U-turning in the heat exchanger 70.

Similarly, the coolant flows through the cooling-medium tubes 43*a* arranged on the upwind side→the cooling-medium communication spaces of the refrigerant tank part 16*c*→the cooling-medium tubes 43*a* arranged on the downwind side, in this order, with U-turning in the heat exchanger 70. Therefore, a flow of the refrigerant in a refrigerant tube 16*a* and a flow of the coolant in a cooling-medium tube 43*a*, which are adjacent to each other, are opposed to each other in their flow direction.

The above-described refrigerant tubes 16*a* of the exterior heat-exchange portion 16, the cooling-medium tubes 43*a* of the radiator portion 43, components of the refrigerant tank part 16*c*, components of the cooling-medium tank part 43*c*, and the outer fins 50 are made from the same metallic material (aluminum alloy in the present embodiment).

The refrigerant fixing plate member 161 and the refrigerant tank forming member 163 are fixed by crimping (joining) in a state where the refrigerant middle plate member 162 is interposed between the refrigerant fixing plate member 161 and the refrigerant tank forming member 163. The cooling-medium fixing plate member 431 and the cooling-medium tank forming member 433 are also fixed by crimping (joining) in a state where the cooling-medium middle plate member 432 is interposed between the cooling-medium fixing plate member 431 and the cooling-medium tank forming member 433.

Subsequently, the heat exchanger 70 in a crimping-fixed state is put into a furnace, and is then heated so that brazing filler metal provided on a clad surface of each component is melted. Then, the brazing filler metal is cooled to be solidified again, and the components are thereby brazed integrally. Accordingly, the exterior heat-exchange portion 16 and the radiator portion 43 are integrated with each other.

As is clear from the above description, refrigerant in the present embodiment corresponds to the first fluid described in claims, coolant corresponds to the second fluid, air (outside air) corresponds to the third fluid, the exterior heat-exchange portion 16 corresponds to a first heat-exchange portion, the radiator portion 43 corresponds to a second heat-exchange portion, the refrigerant tubes 16*a* correspond to first tubes, the refrigerant tank part 16*c* corresponds to a first tank part, the cooling-medium tubes 43*a* correspond to second tubes, and the cooling-medium tank part 43*c* corresponds to a second tank part.

Moreover, the refrigerant fixing plate member 161, the refrigerant middle plate member 162, the refrigerant tank forming member 163 and the cooling-medium communication spaces correspond respectively to a first fixing plate member, a first middle plate member, a first tank forming member and first communication spaces. The cooling-medium fixing plate member 431, the cooling-medium middle plate member 432, the cooling-medium tank forming member 433 and the refrigerant communication spaces correspond respectively to a second fixing plate member, a second middle plate member, a second tank forming member and second communication spaces.

Next, an electric control portion of the present embodiment will be described. The air conditioning controller is configured by a known microcomputer and its peripheral circuit, and the microcomputer includes ROM and RAM. The air conditioning controller performs various calculations and processes based on an air conditioning control program stored in the ROM to control operations of various air conditioning devices 11, 15*a*, 15*b*, 17, 41, 42 and the like connected to an output side of the air conditioning controller.

An input side of the air conditioning controller is connected to a group of various air conditioning sensors. The sensor group includes an inside air sensor that detects a temperature in the vehicle compartment, an outside air sensor that detects an outside temperature, a solar radiation sensor that detects a solar radiation amount in the vehicle compartment, an evaporator temperature sensor that detects a temperature (evaporator temperature) of air flowing out of the interior evaporator 20, a discharged-refrigerant temperature sensor that detects a temperature of refrigerant flowing out of the compressor 11, an outlet refrigerant temperature sensor 51 that detects a temperature Te of refrigerant flowing out of the outlet side of the exterior heat-exchange portion 16, and a coolant temperature sensor 52 that is used as a coolant temperature detection device and detects a temperature Tw of coolant flowing into the vehicle-running electric motor MG.

In the present embodiment, the coolant temperature sensor 52 detects a temperature Tw of coolant transferred from the coolant pump 41, but may detect a temperature Tw of coolant flowing into the coolant pump 41.

The input side of the air conditioning controller is connected to a non-shown control panel arranged near the instrumental panel in the front part of the vehicle compartment. Operation signals are input into the air conditioning controller from various air-conditioning operation switches provided in the control panel. The various air-conditioning operation switches provided in the control panel include an activation switch of the vehicle air conditioner, a vehicle-compartment temperature setting switch used for setting a temperature in the vehicle compartment, and a switch used for selecting an operation mode.

The air conditioning controller is integrated with a control device that controls the electric motor 11*b* of the compressor 11, the open-close valve 15*a* and the like, and the air conditioning controller controls operations of these devices. In the present embodiment, a configuration (hardware and software) within the air conditioning controller, which controls an operation of the compressor 11, constitutes a refrigerant discharge capacity control device. A configuration within the air conditioning controller, which controls operations of devices 15*a* and 15*b* constituting the refrigerant-flow-passage switching device, constitutes a refrigerant-flow-passage control device. A configuration within the air conditioning controller, which controls an operation of the three-way valve 42 constituting the coolant circuit switching device, constitutes a cooling-medium circuit control device.

The air conditioning controller of the present embodiment includes a configuration (frost-formation determination device) that determines whether the exterior heat-exchange portion 16 is frosted, based on detection signals from the above-described group of air conditioning sensors. Specifically, the frost-formation determination device of the present embodiment determines that the exterior heat-exchange portion 16 is frosted, when a vehicle speed is equal to or lower than a predetermined reference speed (20 km/h in the present embodiment), and when the temperature Te of refrigerant flowing out of the outlet side of the exterior heat-exchange portion 16 is equal to or lower than 0° C.

Next, an operation of the vehicle air conditioner 1 of the present embodiment in the above-described configuration will be described. The vehicle air conditioner 1 of the present embodiment is capable of performing the heating operation in which the vehicle compartment is heated, and the cooling operation in which the vehicle compartment is cooled. Additionally, the vehicle air conditioner 1 is capable of performing the defrosting operation and the waste-heat recovery operation during the heating operation. An operation of the vehicle air conditioner 1 in each operation will be described below.

(a) Heating Operation

The heating operation is started when a heating operation mode is selected via the mode selecting switch in a state where the activation switch of the control panel is turned (ON). When the frost-formation determination device determines that the exterior heat-exchange portion 16 is frosted in the heating operation, the defrosting operation is performed. When the coolant temperature Tw detected by the coolant temperature sensor 52 is equal to or higher than a predetermined reference temperature (60° C. in the present embodiment), the waste-heat recovery operation is performed.

In the normal heating operation, the air conditioning controller closes the open-close valve 15*a*, and operates the three-way valve 15*b* to select the refrigerant flow passage connecting the outlet side of the exterior heat-exchange portion 16 and the inlet side of the accumulator 18. Further, the air conditioning controller operates the coolant pump 41 to pump a predetermined flow amount of the coolant, and operates the three-way valve 42 of the coolant circulation circuit 40 to select the cooling-medium circuit through which the coolant bypasses the radiator portion 43.

Accordingly, the heat pump cycle 10 is switched into the refrigerant flow passage in which refrigerant flows as shown by solid arrows in FIG. 1. The coolant circulation circuit 40 is switched into the cooling-medium circuit in which the coolant flows as shown by dash arrows in FIG. 1.

In these configurations of the refrigerant flow passage and the cooling-medium circuit, the air conditioning controller reads in detection signals from the above-described group of air conditioning sensors and operation signals from the control panel. Subsequently, the air conditioning controller calculates the target outlet temperature TAO that is a target temperature of air blown into the vehicle compartment based on values of the detection signals and the operation signals. Furthermore, based on the calculated target outlet temperature TAO and the detection signals from the sensor group, the air conditioning controller determines operation states of the various air conditioning control devices connected to the output side of the air conditioning controller.

For example, a refrigerant discharge capacity of the compressor 11, i.e., a control signal outputted to the electric motor of the compressor 11 is determined as below. First, the air conditioning controller determines a target evaporator temperature TEO of the interior evaporator 20 based on the target outlet temperature TAO by using a control map stored in the air conditioning controller.

Subsequently, the air conditioning controller determines the control signal outputted to the electric motor of the compressor 11 based on a deviation between the target evaporator temperature TEO and the temperature of air blown out of the interior evaporator 20 detected by the evaporator temperature sensor. Here, the control signal outputted to the electric motor of the compressor 11 is determined by using a feed-back control method so that the temperature of air blown out of the interior evaporator 20 approaches the target evaporator temperature TEO.

A control signal outputted to the servomotor of the air mix door 34 is determined by using, for example, the target outlet temperature TAO, a temperature of air flowing out of the interior evaporator 20, and a temperature of refrigerant discharged from the compressor 11 detected by the discharged-refrigerant temperature sensor. The control signal outputted to the servomotor of the air mix door 34 is determined so that a temperature of air blown into the vehicle compartment becomes a desired temperature set by a passenger with the vehicle-compartment temperature setting switch.

An open degree of the air mix door 34 may be controlled so that a total amount of air blown by the blower 32 passes through the interior condenser 12 in the normal heating operation, the defrosting operation and the waste-heat recovery operation.

Control signals and the like determined as described above are outputted to the various air conditioning devices. The air conditioning controller repeats a control routine: the above-described reading in the detection signals and the operation signals→calculation of the target outlet temperature TAO→determination of the operation states of the various air conditioning devices→outputting control voltages and control signals, with a predetermined control period until the vehicle air conditioner is required to be stopped by the control panel. Such repeat of the control routine is generally performed also in the other air conditioning operations similarly.

In the heat pump cycle 10 during the normal heating operation, high-pressure refrigerant discharged from the compressor 11 flows into the interior condenser 12. The refrigerant flowing into the condenser 12 radiates heat through heat exchange with air which has been blown by the blower 32 and has passed through the interior evaporator 20. Accordingly, the air to be blown into the vehicle compartment is heated.

The high-pressure refrigerant flowing out of the interior condenser 12 flows into the heating fixed throttle 13 to be expanded and decompressed because the open-close valve 15*a* is closed. The low-pressure refrigerant expanded and decompressed in the heating fixed throttle 13 flows into the exterior heat-exchange portion 16. The low-pressure refrigerant flowing into the exterior heat-exchange portion 16 absorbs heat from outside air blown by the blower fan 17 to be evaporated.

At this time, because the cooling-medium circuit is switched so that the coolant bypasses the radiator portion 43 in the cooling-medium circulation circuit 40, the coolant does not radiate heat to the refrigerant flowing through the exterior heat-exchange portion 16 or does not absorb heat from the refrigerant flowing through the exterior heat-exchange portion 16. In other words, the coolant does not thermally affect the refrigerant flowing through the exterior heat-exchange portion 16.

The refrigerant flowing out of the exterior heat-exchange portion 16 flows into the accumulator 18 to be separated into gas refrigerant and liquid refrigerant because the refrigerant flow passage is switched by the three-way valve 15*b* to connect the outlet side of the exterior heat-exchange portion 16 and the inlet side of the accumulator 18. The liquid refrigerant separated by the accumulator 18 is drawn into the compressor 11 to be compressed again.

As described above, in the normal heating operation, air to be blown into the vehicle compartment is heated in the interior condenser 12 by heat of refrigerant discharged from the compressor 11, and the vehicle compartment can be thereby heated.

(b) Defrosting Operation

Next, the defrosting operation will be described. The exterior heat-exchange portion 16 may be frosted when a refrigerant evaporation temperature in the exterior heat-exchange portion 16 is equal to or lower than a frost-formation temperature (0° C., specifically) in a refrigeration cycle device as with the heat pump cycle 10 of the present embodiment, in which refrigerant is evaporated in the exterior heat-exchange portion 16 via heat exchange with outside air.

When such frost is generated, the outside air passages 70*a* of the heat exchanger 70 may be clogged with the frost. Accordingly, a heat exchange capacity of the exterior heat-exchange portion 16 may be reduced drastically. In the heat pump cycle 10 of the present embodiment, the defrosting operation is performed when the frost-formation determination device determines that the exterior heat-exchange portion 16 is frosted during the heating operation.

In the defrosting operation, the air conditioning controller stops an operation of the compressor 11, and stops an operation of the blower fan 17. Hence, in the defrosting operation, a flow amount of refrigerant flowing into the exterior heat-exchange portion 16 is decreased, and a flow amount of outside air flowing into the outside air passages 70*a* is reduced.

Figure 2:
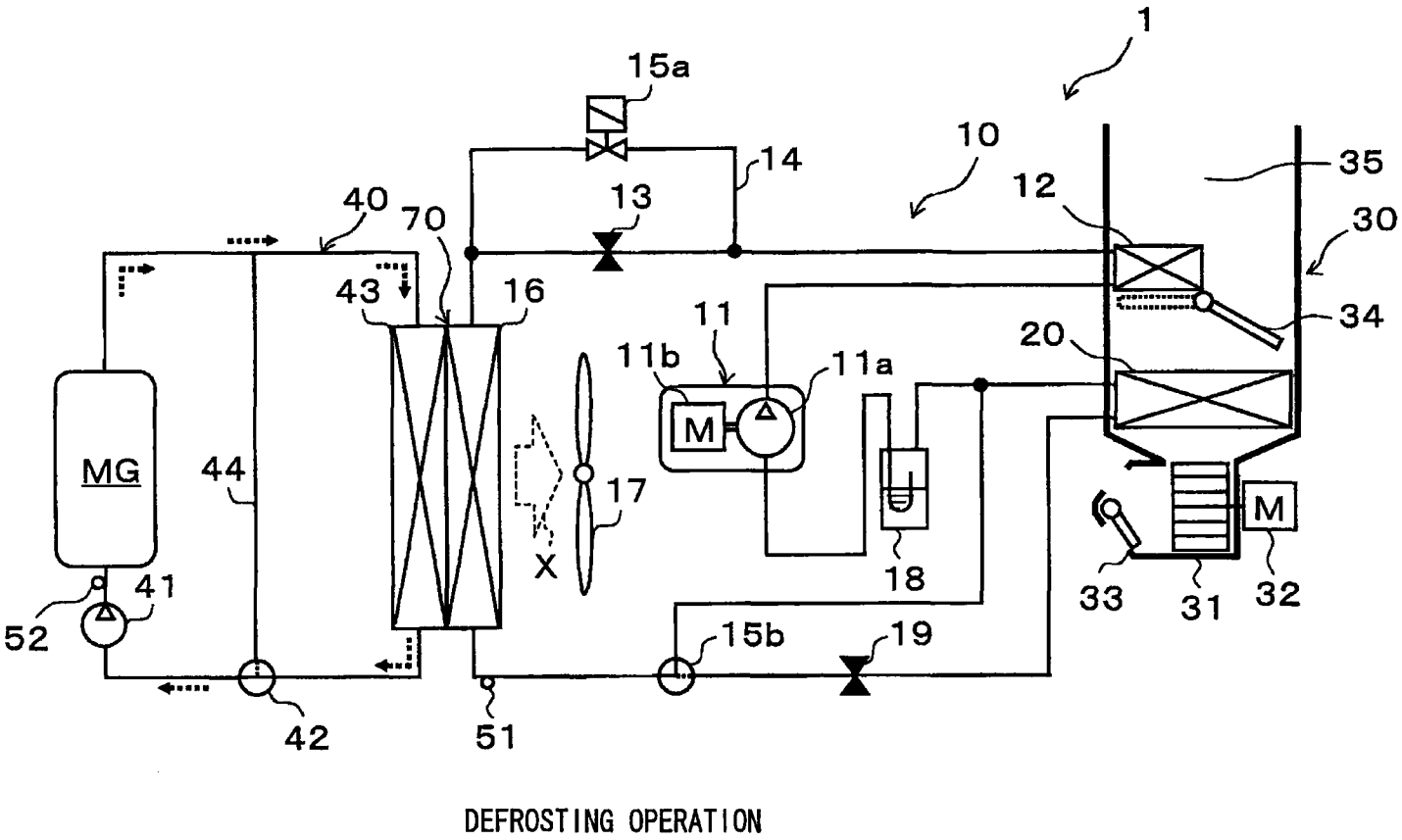
FIG. 2 is an entire configuration diagram showing a refrigerant flow passage in a defrosting operation of the heat pump cycle, according to the first embodiment.

Moreover, the air conditioning controller switches the three-way valve 42 of the coolant circulation circuit 40 to select the cooling-medium circuit in which the coolant flows into the radiator portion 43 as shown by dash lines in FIG. 2. Accordingly, refrigerant does not circulate in the heat pump cycle 10, and the coolant circulation circuit 40 is switched into the cooling-medium circuit in which the coolant flows as shown by the dash lines in FIG. 2.

Therefore, heat of the coolant flowing through the cooling-medium tubes 43*a* of the radiator portion 43 is transferred to the exterior heat-exchange portion 16 via the outer fins 50, so that the exterior heat-exchange portion 16 is defrosted. As a result, defrosting is performed, with utilizing waste heat of the vehicle-running electric motor MG effectively.

(c) Waste-heat Recovery Operation

Next, the waste-heat recovery operation will be described. In order to limit overheat of the vehicle-running electric motor MG, the coolant temperature is preferred to be kept equal to or lower than a predetermined upper limit temperature. Additionally, in order to reduce friction loss due to increase of viscosity of lubrication oil enclosed in the vehicle-running electric motor MG, the coolant temperature is preferred to be set equal to or higher than a predetermined lower limit temperature.

In the heat pump cycle 10 of the present embodiment, the waste-heat recovery operation is performed when the coolant temperature Tw is equal to or higher than a predetermined reference temperature (60° C. in the present embodiment) during the heating operation. In the waste-heat recovery operation, the three-way valve 15*b* of the heat pump cycle is operated similarly to the normal heating operation, and the three-way valve 42 of the coolant circulation circuit 40 is switched to select the cooling-medium circuit in which the coolant flows as shown by dash lines in FIG. 3, similarly to the defrosting operation.

Figure 3:
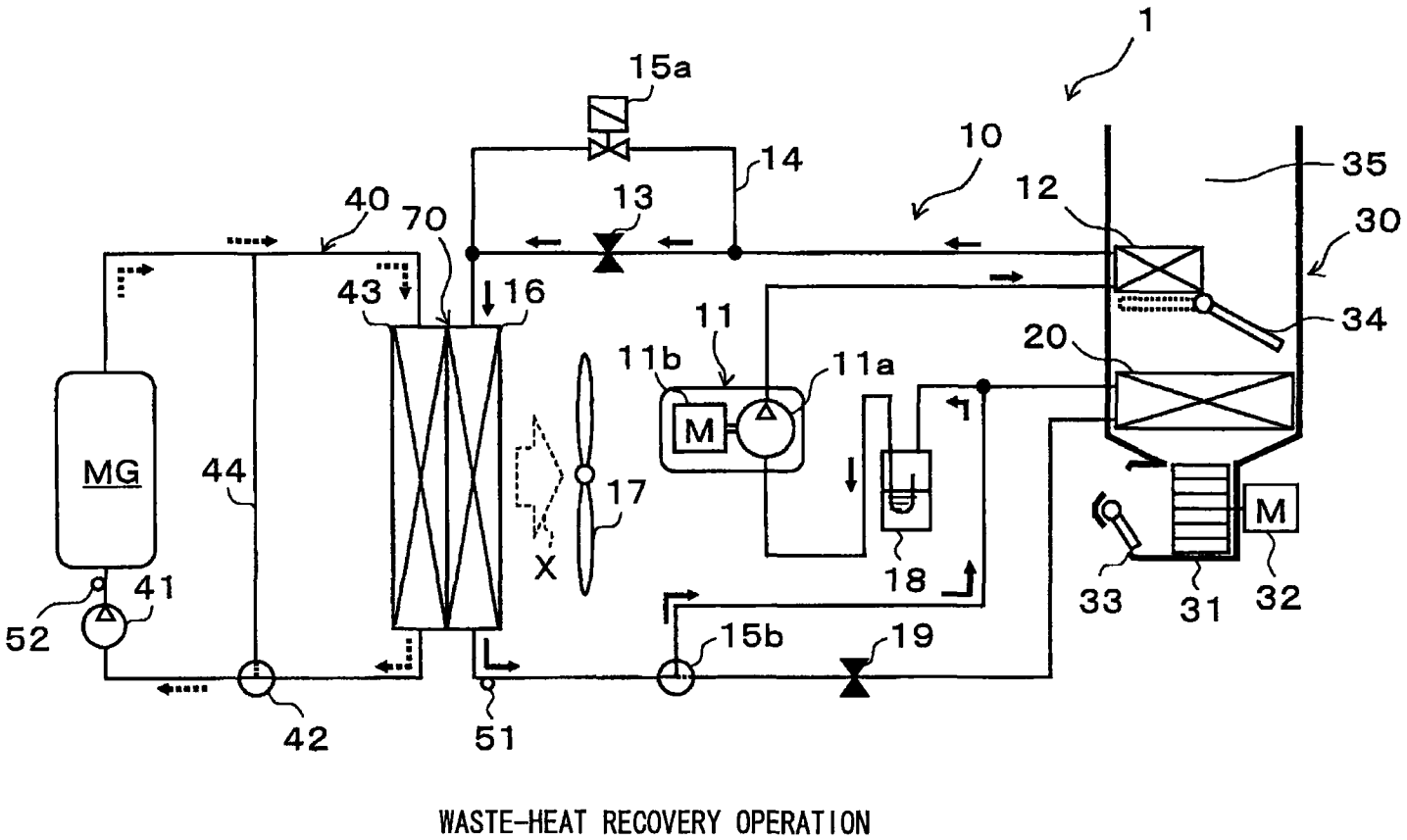
FIG. 3 is an entire configuration diagram showing a refrigerant flow passage in a waste-heat recovery operation of the heat pump cycle, according to the first embodiment.

Thus, as shown by solid arrows in FIG. 3, high-pressure and high-temperature refrigerant discharged from the compressor 11 heats air, blown to the vehicle compartment, in the interior condenser 12, and the refrigerant is then expanded and decompressed in the heating fixed throttle 13 to flow into the exterior heat-exchange portion 16.

The low-pressure refrigerant flowing into the exterior heat-exchange portion 16 absorbs heat of outside air blown by the blower fan 17, and further absorbs heat transmitted from the coolant via the outer fins 50 to be evaporated because the three-way valve 42 is switched to select the cooling-medium circuit in which the coolant flows into the radiator portion 43. The other operations are similar to those in the normal heating operation.

As described above, in the waste-heat recovery operation, air to be blown into the vehicle compartment is heated in the interior condenser 12 with heat of refrigerant discharged from the compressor 11, and the vehicle compartment can be thereby heated. Here, because the refrigerant absorbs not only the heat of outside air but also the heat transferred from the coolant through the outer fins 50, waste heat of the vehicle-running electric motor MG can be utilized effectively in the heating operation of the vehicle compartment.

(d) Cooling Operation

The cooling operation is started when a cooling operation mode is selected via the mode selecting switch in a state where the activation switch of the control panel is turned (ON). In the cooling operation, the air conditioning controller opens the open-close valve 15*a*, and operates the three-way valve 15*b* to select the refrigerant flow passage connecting the outlet side of the exterior heat-exchange portion 16 and the inlet side of the cooling fixed throttle 19. Accordingly, the heat pump cycle 10 is switched into a refrigerant flow passage in which refrigerant flows as shown by solid arrows in FIG. 4.

Figure 4:
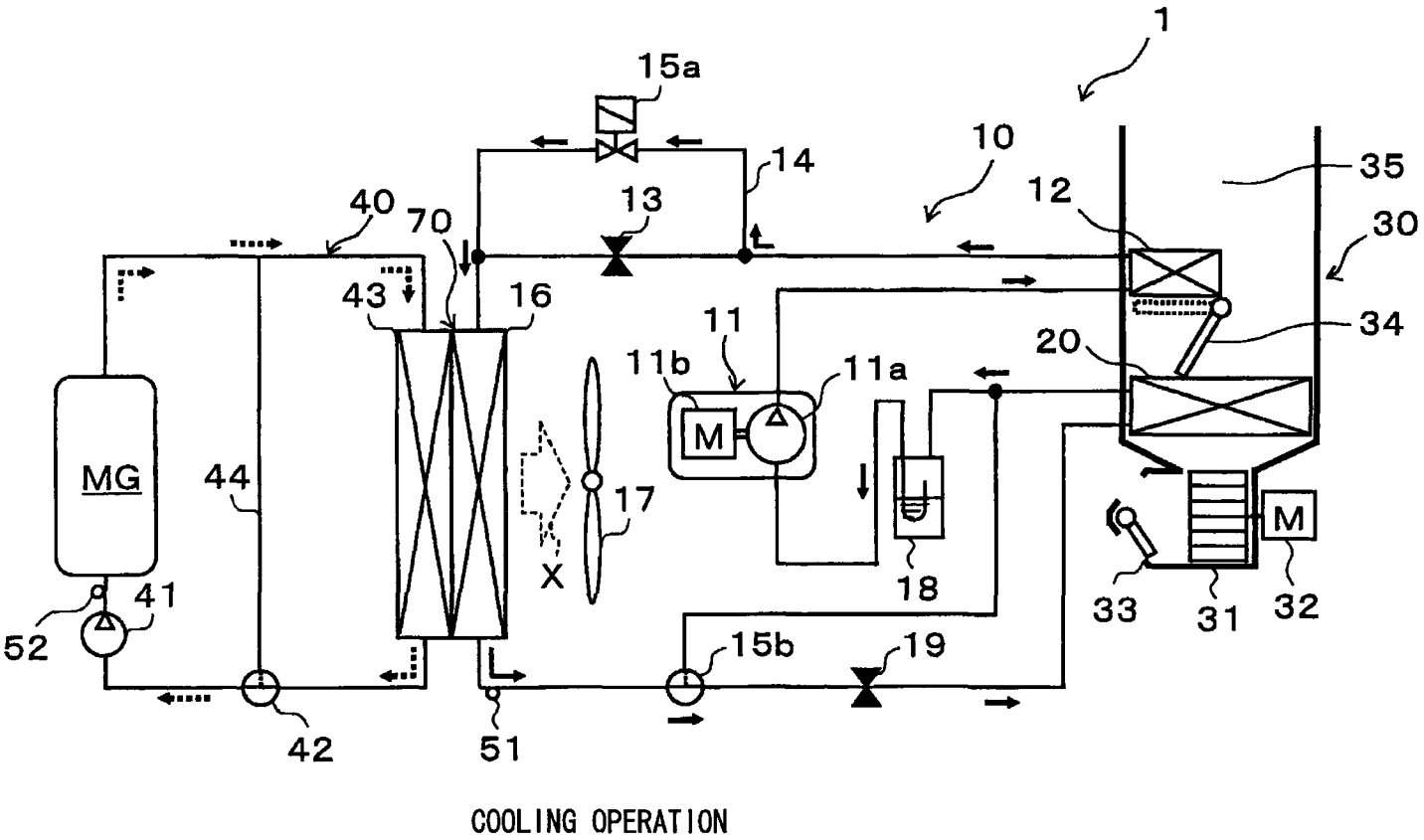
FIG. 4 is an entire configuration diagram showing a refrigerant flow passage in a cooling operation of the heat pump cycle, according to the first embodiment.

In this case, when the coolant temperature Tw is equal to or higher than a reference temperature, the three-way valve 42 of the coolant circulation circuit 40 is switched to select the cooling-medium circuit where the coolant flows into the radiator portion 43. When the coolant temperature Tw is lower than the reference temperature, the three-way valve 42 is switched to select the cooling-medium circuit where the coolant bypasses the radiator portion 43. In FIG. 4, a flow of the coolant is shown by dash arrows when the coolant temperature Tw is equal to or higher than the reference temperature.

In the heat pump cycle 10 during the cooling operation, high-pressure refrigerant discharged from the compressor 11 flows into the interior condenser 12, and radiates heat through heat exchange with air which has been blown by the blower 32 and has passed through the interior radiator 20. The air is to be blown into the vehicle compartment. The high-pressure refrigerant flows out of the interior condenser 12, and flows into the exterior heat-exchange portion 16 through the fixed-throttle bypass passage 14 because the open-close valve 15*a* is open. High-pressure refrigerant flowing into the exterior heat-exchange portion 16 further radiates heat to outside air blown by the blower fan 17.

The refrigerant flowing out of the exterior heat-exchange portion 16 is decompressed and expanded in the cooling fixed-throttle 19 because the three-way valve 15*b* is switched to select the refrigerant flow passage connecting the outlet side of the exterior heat-exchange portion 16 and the inlet side of the cooling fixed-throttle 19. The refrigerant flowing out of the cooling fixed-throttle 19 flows into the interior evaporator 20 to evaporate via heat absorption from air blown by the blower 32. Accordingly, the air to be blown into the vehicle compartment is cooled.

The refrigerant flowing out of the interior evaporator 20 flows into the accumulator 18 to be separated into gas refrigerant and liquid refrigerant. The gas refrigerant separated by the accumulator 18 is drawn into the compressor 11 to be compressed again. As described above, in the cooling operation, because low-pressure refrigerant evaporates in the interior evaporator 20 via heat absorption from air that is to be blown into the vehicle compartment, the air to be blown into the vehicle compartment can be cooled, and cooling of the vehicle compartment can be thereby performed.

In the vehicle air conditioner 1 of the present embodiment, as described above, a variety of operations can be performed by switching the refrigerant flow passage of the heat pump cycle 10 and the cooling-medium circuit of the coolant circulation circuit 40. Further, in the present embodiment, because the characteristic heat exchanger 70 described above is used, appropriate heat exchanges can be thereby performed in each operation among the three fluids that are refrigerant, coolant and outside air.

More specifically, in the heat exchanger 70 of the present embodiment, the outer fins 50 are arranged in the outside air passages 70*a* provided between the refrigerant tubes 16*a* of the exterior heat-exchange portion 16 and the cooling-medium tubes 43*a* of the radiator portion 43. Through the outer fins 50, heat can be transferred between the refrigerant tubes 16*a* and the cooling-medium tubes 43*a*.

Because heat of the coolant can be transmitted to the exterior heat-exchange portion 16 through the outer fins 50 in the defrosting operation, waste heat of the vehicle-running electric motor MG can be utilized effectively for defrosting in the exterior heat-exchange portion 16.

Moreover, in the present embodiment, a flow amount of refrigerant flowing into the exterior heat-exchange portion 16 is reduced by stopping an operation of the compressor 11 during the defrosting operation. Hence, it can be limited that the refrigerant passing through the refrigerant tubes 16*a* absorbs the heat transmitted to the exterior heat-exchange portion 16 through the outer fins 50 and the refrigerant tubes 16*a*. In other words, unnecessary heat exchange between the refrigerant and the coolant can be reduced.

Additionally, a flow amount of outside air flowing into the outside air passages 70*a* is reduced by stopping an operation of the blower fan 17 during the defrosting operation. Hence, it can be limited that outside air passing through the outside air passages 70*a* absorbs the heat transmitted to the exterior heat-exchange portion 16 through the outer fins 50. In other words, unnecessary heat exchange between the coolant and outside air can be reduced.

In the waste-heat recovery operation, waste heat of the vehicle-running electric motor MG can be absorbed into the refrigerant via heat exchange between the refrigerant and the coolant through the refrigerant tubes 16*a*, the cooling-medium tubes 43*a* and the outer fins 50. Additionally, unnecessary waste heat of the vehicle-running electric motor MG can be radiated to outside air via heat exchange between the coolant and the outside air through the cooling-medium tubes 43*a* and the outer fins 50.

In the normal heating operation, heat of outside air can be absorbed into the refrigerant via heat exchange between the refrigerant and the outside air through the refrigerant tubes 16*a* and the outer fins 50. Further, in the normal heating operation, the three-way valve 42 of the coolant circulation circuit 40 is switched to select the cooling-medium circuit where the coolant bypasses the radiator portion 43. Hence, unnecessary heat exchange between the coolant and outside air can be reduced, and waste heat of the vehicle-running electric motor MG can be accumulated in the coolant. Additionally, heating of the vehicle-running electric motor MG can be promoted.

The heat exchanger 70 of the present embodiment has the structure in which both the refrigerant tubes 16*a* and the cooling-medium tubes 43*a* is fixed to both the refrigerant tank part 16*c* and the cooling-medium tank part 43*c*. Thus, complication and large-sizing of the structure of the heat exchanger 70 can be limited.

Both tubes 16*a* and 43*a* are fixed to the refrigerant tank part 16*c* that is a necessary component for collecting refrigerant from the refrigerant tubes 16*a* and for distributing refrigerant to the refrigerant tubes 16*a*. The tubes 16*a* and 43*a* are fixed also to the cooling-medium tank part 43*c* that is a necessary component for collecting coolant from the cooling-medium tubes 43*a* and for distributing coolant to the cooling-medium tubes 43*a*. Hence, both tubes 16*a* and 43*a* can be formed into shapes approximately similar to each other.

Therefore, as not in a conventional technology, one of the refrigerant tubes 16*a* and the cooling-medium tubes 43*a* is not required to be bended, and complication and large-sizing of the structure of the heat exchanger 70 can be thereby limited as a whole.

In the heat exchanger 70 of the present embodiment, the first communication holes 162*a* are provided in the refrigerant middle plate member 162, through which the refrigerant tubes 16*a* communicate with the inside of the refrigerant tank forming member 163. The second communication holes 432*a* are provided in the cooling-medium middle plate member 432, through which the cooling-medium tubes 43*a* communicate with the inside of the cooling-medium tank forming member 433.

Hence, even though both the tubes 16*a* and 43*a* are fixed to the refrigerant tank part 16*c* and the cooling-medium tank part 43*c*, a configuration can be realized easily and certainly, where the refrigerant tank part 16*c* functions to collect refrigerant from the refrigerant tubes 16*a* and to distribute refrigerant to the refrigerant tubes 16*a*, and where the cooling-medium tank part 43*c* functions to collect coolant from the cooling-medium tubes 43*a* and to distribute coolant to the cooling-medium tubes 43*a*.

In the heat exchanger 70 of the present embodiment, the refrigerant tubes 16*a* and the cooling-medium tubes 43*a* are arranged in multiple rows with respect to the flow direction X of outside air flowing through the outside air passages 70*a*. The cooling-medium communication spaces are provided between the refrigerant fixing plate member 161 and refrigerant middle plate member 162, so that the cooling-medium tubes 43*a* arranged with respect to the flow direction X of outside air communicate with one another through the cooling-medium communication spaces.

Additionally, the refrigerant communication spaces are provided between the cooling-medium fixing plate member 431 and the cooling-medium middle plate member 432, so that the refrigerant tubes 16*a* arranged with respect to the flow direction X of outside air communicate with one another through the refrigerant communication spaces.

The cooling-medium communication spaces can be provided as flow passages inside the refrigerant tank part 16*c*, through which the coolant flows out of the cooling-medium tubes 43*a* fixed to the refrigerant tank part 16*c*. The refrigerant communication spaces can be provided as flow passages inside the cooling-medium tank part 43*c*, through which the refrigerant flows out of the refrigerant tubes 16*a* fixed to the cooling-medium tank part 43*c*. Therefore, large-sizing of the heat exchanger can be limited as a whole even when the refrigerant tubes 16*a* and the cooling-medium tubes 43*a* are arranged in multiple rows with respect to the flow direction X of outside air.

(Second Embodiment)

Figure 9:
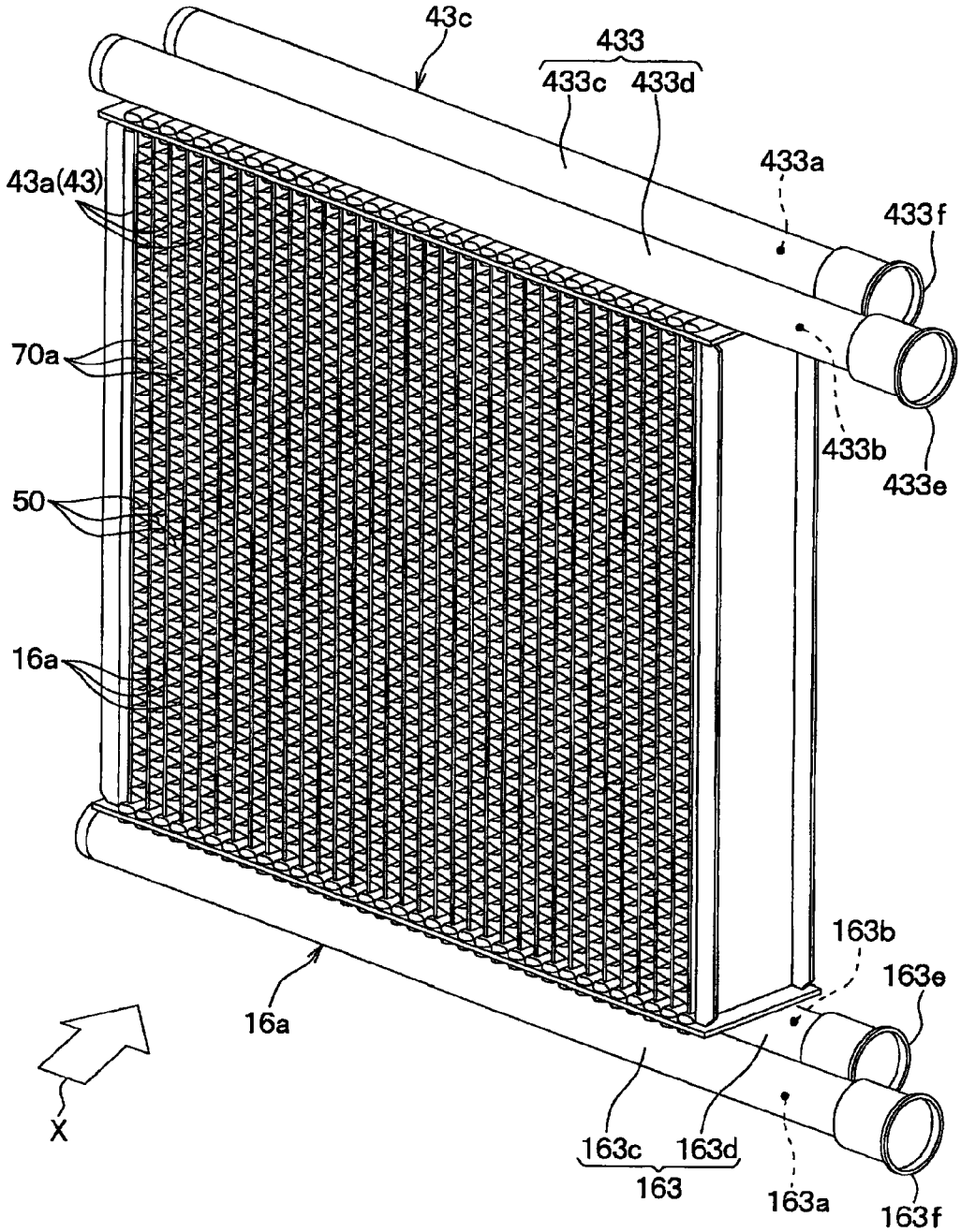
FIG. 9 is a perspective view showing a heat exchanger according to a second embodiment.
Figure 10:
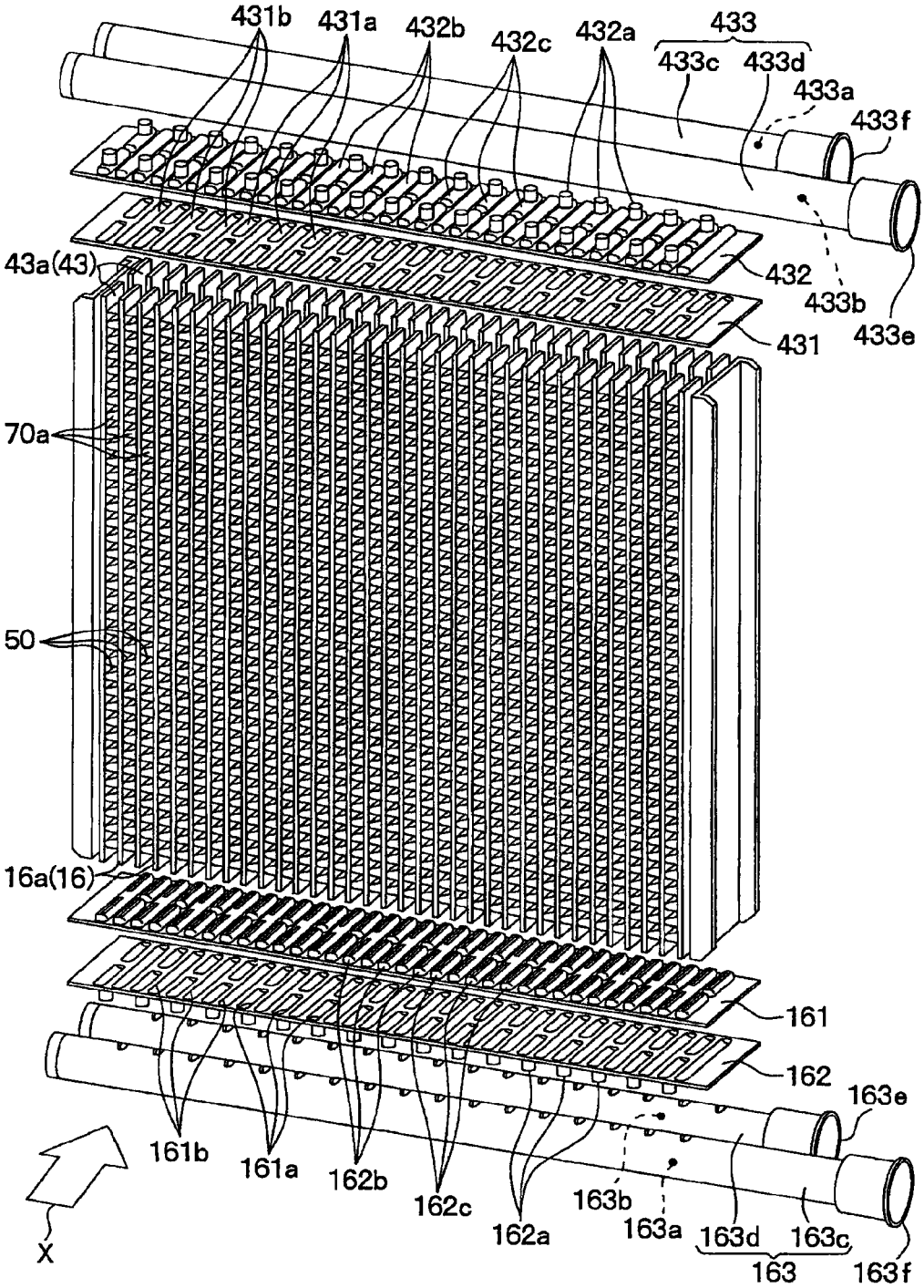
FIG. 10 is an exploded view showing the heat exchanger according to the second embodiment.

In a present embodiment, an example will be described, in which a configuration of a heat exchanger 70 is different from that in the first embodiment. A detailed configuration of the heat exchanger 70 of the present embodiment will be described referring to FIGS. 9 and 10. FIG. 9 is a perspective view of the heat exchanger 70, and corresponds to FIG. 5 of the first embodiment. FIG. 10 is an exploded view of the heat exchanger 70, and corresponds to FIG. 6 of the first embodiment. Parts in FIGS. 9 and 10 same as or similar to parts of the first embodiment are assigned same numerals as the parts of the first embodiment. These are applied also to following drawings.

As shown in FIGS. 9 and 10, an exterior heat-exchange portion 16 and a radiator portion 43 of the heat exchanger 70 of the present embodiment include refrigerant tubes 16*a* and cooling-medium tubes 43*a* respectively, similarly to the first embodiment. In other words, both the exterior heat-exchange portion 16 and the radiator portion 43 have tank-and-tube type heat-exchanger configurations.

In the present embodiment, basic configurations of a refrigerant tank part 16*c* and a cooling-medium tank part 43*a* are similar to each other. The refrigerant tank part 16*c* of the present embodiment includes a refrigerant fixing plate member 161, a refrigerant middle plate member 162 and a refrigerant tank forming member 163. The refrigerant tank forming member 163 includes a refrigerant-collection tank forming member 163*c* and a refrigerant-distribution tank forming member 163*d*.

The refrigerant-collection tank forming member 163*c* and the refrigerant-distribution tank forming member 163*d* are made from tubular members. The refrigerant-collection tank forming member 163*c* has a collection space 163*a* therein, and the refrigerant-distribution tank forming member 163*d* has a distribution space 163*b* therein. The collection space 163*c* and the distribution space 163*b* are separated from each other.

A refrigerant inflow port 163*e* is provided in one end portion of the refrigerant-distribution tank forming member 163*d* in a longitudinal direction thereof. Though the refrigerant inflow port 163*e*, refrigerant flows into the distribution space 163*b* provided inside the refrigerant-distribution tank forming member 163*d*. The other end portion of the refrigerant-distribution tank forming member 163*d* in the longitudinal direction thereof is closed. A refrigerant outflow port 163*f* is provided in one end portion of the refrigerant-collection tank forming member 163*c* in a longitudinal direction thereof. Through the refrigerant outflow port 163*f*, refrigerant flows out of the collection space 163*a* provided inside the refrigerant-collection tank forming member 163*c*. The other end portion of the refrigerant-collection tank forming member 163*c* in the longitudinal direction thereof is closed.

The refrigerant middle plate member 162 of the present embodiment has first communication holes 162*a* that penetrate through the refrigerant middle plate member 162. Refrigerant tubes 16*a*, which are arranged on an upwind side in the flow direction X of outside air, communicate with the collection space 163*a* through the first communication holes 162*a*, and refrigerant tubes 16*a*, which are arranged on a downwind side in the flow direction X of outside air, communicate with the distribution space 163*b* through the first communication holes 162*a*.

Moreover, the refrigerant middle plate member 162 and the refrigerant fixing plate member 161 of the present embodiment have recessed parts. The recessed parts are located at positions respectively corresponding to positions of the refrigerant tubes 16*a* and the cooling-medium tubes 43*a* and have shapes similar to those in the first embodiment.

More specifically, the refrigerant middle plate member 162 has recessed parts 162*b* located at positions corresponding to positions of the cooling-medium tubes 43*a*, and recessed parts 162*c* located at positions corresponding to positions of the refrigerant tubes 16*a*. The refrigerant fixing plate member 161 has recessed parts 161*b* located at positions corresponding to positions of the cooling-medium tubes 43*a*, and recessed parts 161*a* located at positions corresponding to positions of the refrigerant tubes 16*a*.

Thus, by fixing the refrigerant middle plate member 162 and the refrigerant fixing plate member 161 to each other, spaces are provided between the recessed parts 162*c* and 161*a* that are provided at the positions corresponding to the positions of the refrigerant tubes 16*a*, and spaces are provided between the recessed parts 162*b* and 161*b* that are provided at the positions corresponding to the positions of the cooling-medium tubes 43*a*.

Furthermore, the recessed parts 162*b* and 161*b*, which are provided at the positions corresponding to the positions of the cooling-medium tubes 43*a*, extend to communicate with the cooling-medium tubes 43*a* arranged in two rows with respect to the flow direction X of outside air. Accordingly, the spaces provided between the recessed parts 162*b* and 161*b*, which are provided at the positions corresponding to the positions of the cooling-medium tubes 43*a*, function as cooling-medium communication spaces through which the cooling-medium tubes 43*a* arranged in two rows with respect to the flow direction X of outside air communicate with each other.

On the other hand, as shown in FIG. 10, the cooling-medium tank part 43*c* includes a cooling-medium fixing plate member 431, a cooling-medium middle plate member 432 and a cooling-medium tank forming member 433. The cooling-medium tank forming member 433 includes a cooling-medium-collection tank forming member 433*c* and a cooling-medium-distribution tank forming member 433*d*.

A cooling-medium inflow port 433*e* is provided in one end portion of the cooling-medium-distribution tank forming member 433*d* in a longitudinal direction thereof, and the coolant flows through the cooling-medium inflow port 433*e* into a distribution space 433*b* provided inside the cooling-medium-distribution tank forming member 433*d*. The other end portion of the cooling-medium-distribution tank forming member 433*d* in the longitudinal direction thereof is closed. A cooling-medium outflow port 433*f* is provided in one end portion of the cooling-medium-collection tank forming member 433*c* in a longitudinal direction thereof, and the coolant flows through the cooling-medium outflow port 433*f* out of a collection space 433*a* provided inside the cooling-medium-collection tank forming member 433*c*. The other end portion of the cooling-medium-collection tank forming member 433*c* in the longitudinal direction thereof is closed.

The cooling-medium middle plate member 432 of the present embodiment has second communication holes 432*a* that penetrate through the cooling-medium middle plate member 432. Cooling-medium tubes 43*a*, which are arranged on an upwind side in the flow direction X of outside air, communicate with the distribution space 433*b* through the second communication holes 432*a*, and cooling-medium tubes 43*a*, which are arranged on a downwind side in the flow direction X of outside air, communicate with the collection space 433*a* through the second communication holes 432*a*.

Spaces are provided between recessed parts 432*c* of the cooling-medium middle plate member 432 and recessed parts 431*a* of the cooling-medium fixing plate member 431. The recessed parts 432*c* and 431*a* are located at positions corresponding to positions of the cooling-medium tubes 43*a*. Refrigerant communication spaces are provided between recessed parts 432*b* of the cooling-medium middle plate member 432 and recessed parts 431*b* of the cooling-medium fixing plate member 431. The recessed parts 432*b* and 431*b* are located at positions corresponding to positions of the refrigerant tubes 16*a*.

Accordingly, in the heat exchanger 70 of the present embodiment, the refrigerant and the coolant are capable of flowing similarly in FIG. 8 of the first embodiment. The other components and operations of a heat pump cycle 10 (vehicle air conditioner 1) are similar to those of the first embodiment. Therefore, when the vehicle air conditioner 1 of the present embodiment is operated, effects similar to those of the first embodiment can be obtained.

In the heat exchanger 70 of the present embodiment, the refrigerant-collection tank forming member 163*c* and the refrigerant-distribution tank forming member 163*d*, which are made from tubular members, are adopted as the refrigerant tank forming member 163. Additionally, the cooling-medium-collection tank forming member 433*c* and the cooling-medium-distribution tank forming member 433*d*, which are made from tubular members, are adopted as the cooling-medium tank forming member 433. Accordingly, the refrigerant tank forming member 163 and the cooling-medium tank forming member 433 can be formed easily at low cost.

Moreover, in the heat exchanger 70 of the present embodiment, the spaces communicating with each of the tubes 16*a*, 43*a* are provided between the refrigerant fixing plate member 161 and the refrigerant middle plate member 162, and the spaces communicating with each of the tubes 16*a*, 43*a* are provided between the cooling-medium fixing plate member 431 and cooling-medium middle plate member 432.

Accordingly, a configuration is not required to be adopted, in which the refrigerant tubes 16*a* protrude toward the refrigerant tank part 16*c* more than the cooling-medium tubes 43*a* protrude, and the cooling-medium tubes 43*a* protrude toward the cooling-medium tank part 43*c* more than the refrigerant tubes 16*a* protrude. Therefore, position adjustment of each of the tubes 16*a*, 43*a* relative to the tank parts 16*c*, 43*c* can be made to be easy, and each of the tubes 16*a*, 43*a* can be fixed easily. (Specifically, each of the tubes 16*a*, 43*a* can be fixed easily to each fixing plate member 161, 431).

(Third Embodiment)

Figure 11:
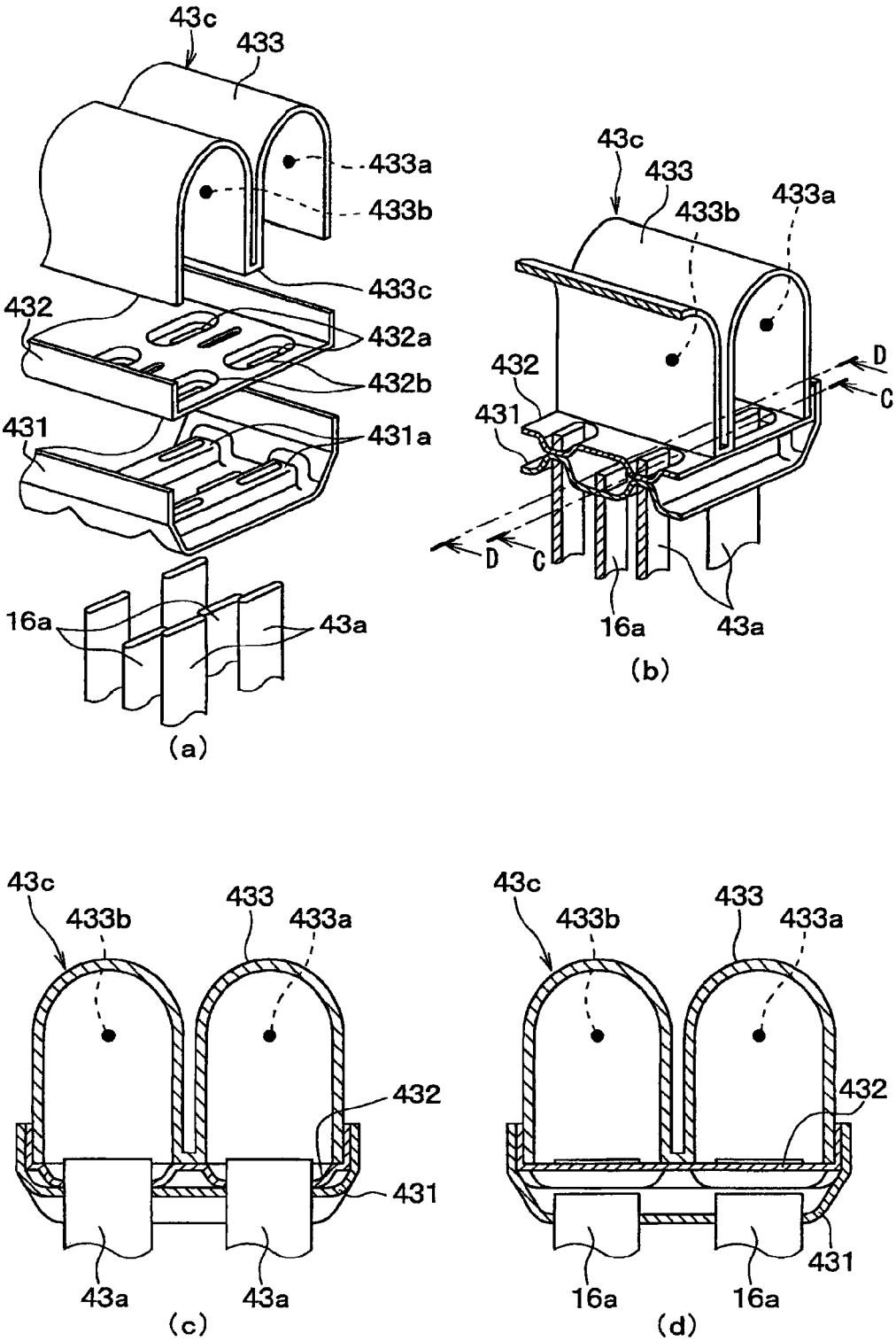
FIG. 11 (*a*) is an exploded view showing a portion of a heat exchanger according to a third embodiment, which corresponds to a portion B in FIG. 6, FIG. 11 (*b*) is a perspective view showing a portion of the heat exchanger corresponding to the portion in FIG. 11 (*a*), and showing a sectional surface of the portion of the heat exchanger according to the third embodiment, FIG. 11 (*c*) is a sectional view taken from a line C-C in FIG. 11 (*b*), and FIG. 11 (*d*) is a sectional view taken from a line D-D in FIG. 11 (*b*).

In a present embodiment, an example will be described, in which a configuration of a heat exchanger 70 is different from that in the first embodiment. A detailed configuration of the heat exchanger 70 according to the present embodiment will be described with reference to FIGS. 11(*a*), (*b*), (c) and (d). FIG. 11(*a*) is an exploded view of the heat exchanger 70 of the present embodiment, and shows an enlarged portion corresponding to a portion B of FIG. 6 of the first embodiment. FIG. 11(*b*) is a perspective view of a portion corresponding to FIG. 11(*a*), and shows a sectional surface of the portion. FIG. 11(*c*) is a sectional view taken along a line C-C of FIG. 11(*b*), and FIG. 11(*d*) is a sectional view taken along a line D-D of FIG. 11(*b*).

More specifically, in the heat exchanger 70 of the present embodiment, configurations of a refrigerant fixing plate member 161 and a refrigerant middle plate member 162 of a refrigerant tank part 16*c* are different from those of the first embodiment. Additionally, in the heat exchanger 70 of the present embodiment, configurations of a cooling-medium fixing plate member 431 and a cooling-medium middle plate member 432 of a cooling-medium tank part 43*c* are also different from those of the first embodiment.

Similarly to the first embodiment, basic configurations of the refrigerant tank part 16*c* and the cooling-medium tank part 43*c* are similar to each other. Thus, the cooling-medium tank part 43*c* will be described below.

As shown in FIG. 11(*a*), the cooling-medium fixing plate member 431 of the present embodiment has recessed parts 431*a* that are recessed toward a cooling-medium tank forming member 433. Cooling-medium tubes 43*a* are fixed to the recessed parts 431*a*, and refrigerant tubes 16*a* are fixed to portions of the cooling-medium fixing plate member 431 where the recessed parts 431*a* are not provided.

End portions of the cooling-medium tubes 43*a* on the side of the cooling-medium tank part 43*c* protrude toward the cooling-medium tank part 43*c* more than end portions of the refrigerant tubes 16*a* on the side of the cooling-medium tank part 43*c* protrude. In other words, the end portions of the cooling-medium tubes 43*a* on the side of the cooling-medium tank part 43*c* and the end portions of the refrigerant tubes 16*a* on the side of the cooling-medium tank part 43*c* are not in alignment with each other.

The cooling-medium middle plate member 432 has recessed parts 432*b* that are recessed in a direction away from the cooling-medium tank forming member 433 differently from the first embodiment. The recessed parts 432*b* are provided at positions corresponding to the recessed parts 431*a* of the cooling-medium fixing plate member 431, and the recessed parts 432*b* have second communication holes 432*a* through which the cooling-medium tubes 43*a* extend.

As shown in FIG. 11(*b*), the cooling-medium fixing plate member 431 and the cooling-medium middle plate member 432 are fixed, and the recessed parts 431*a* of the cooling-medium fixing plate member 431 contact the recessed parts 432*b* of the cooling-medium middle plate member 432.

As shown in FIG. 11(*c*), the cooling-medium tubes 43*a* penetrate through the second communication holes 432*a* to communicate with a collection space 433*a* and a distribution space 433*b* which are provided inside the cooling-medium tank forming member 433.

As shown in FIG. 11(*d*), refrigerant communication spaces are provided in areas where the recessed parts 431*a* of the cooling-medium fixing plate member 431 do not contact the recessed parts 432*b* of the cooling-medium middle plate member 432. The refrigerant tubes 16*a*, which are arranged in two rows with respect to the flow direction X of outside air, communicate with each other through the refrigerant communication spaces.

The other configurations of the heat exchanger 70 are similar to those of the first embodiment. Thus, in the heat exchanger 70 of the present embodiment, refrigerant and coolant can be made to flow similarly to the flow shown in FIG. 8 of the first embodiment. As a result, when a vehicle air conditioner 1 of the present embodiment is operated, effects similar to those of the first embodiment can be obtained.

In the cooling-medium tank part 43*c* of the heat exchanger 70 of the present embodiment, the recessed parts 431*a*, 432*b* are provided respectively in the cooling-medium fixing plate member 431 and the cooling-medium middle plate member 432. Hence, the cooling-medium tubes 43*a* can be easily made to communicate with the spaces provided inside the cooling-medium tank forming member 433, and the refrigerant communication spaces can be provided easily.

In the heat exchanger 70 of the present embodiment, the recessed parts 432*b* of the cooling-medium middle plate member 432 are recessed in the direction away from the cooling-medium tank forming member 433. Thus, a center part 433*c* of the cooling-medium tank forming member 433, through which the collection space 433*a* is separated from the distribution space 433*b*, can be formed into a flat shape.

Consequently, a probability of joint fault in brazing between the center part 433*c* of the cooling-medium tank forming member 433 and the cooling-medium middle plate member 432 can be reduced, and a fault probability of sealing of the collection space 433*a* and the distribution space 433*b* can be reduced.

Furthermore, when the recessed parts 431*a*, 432*b* are provided in the plate members 431, 432 respectively as in the present embodiment, the end portions of the refrigerant tubes 16*a* on the side of the cooling-medium tank part 43*c* and the end portions of the cooling-medium tubes 43*a* on the side of the cooling-medium tank part 43*c* can be aligned by adjusting directions to which the recessed parts 431*a*, 432*b* are recessed and by adjusting depths of the recessed parts 431*a*, 432*b*. The end portions of the cooling-medium tubes 43*a* can be made not to protrude toward the cooling-medium tank part 43*c* more than the refrigerant tubes 16*a* protrude.

In the above description, a detailed description about the refrigerant tank part 16*c* is omitted, but, in the present embodiment, the refrigerant fixing plate member 161 and the refrigerant middle plate member 162 of the refrigerant tank part 16*c* have recessed parts similar to those of the cooling-medium tank part 43*c*.

(Fourth Embodiment)

Figure 12:
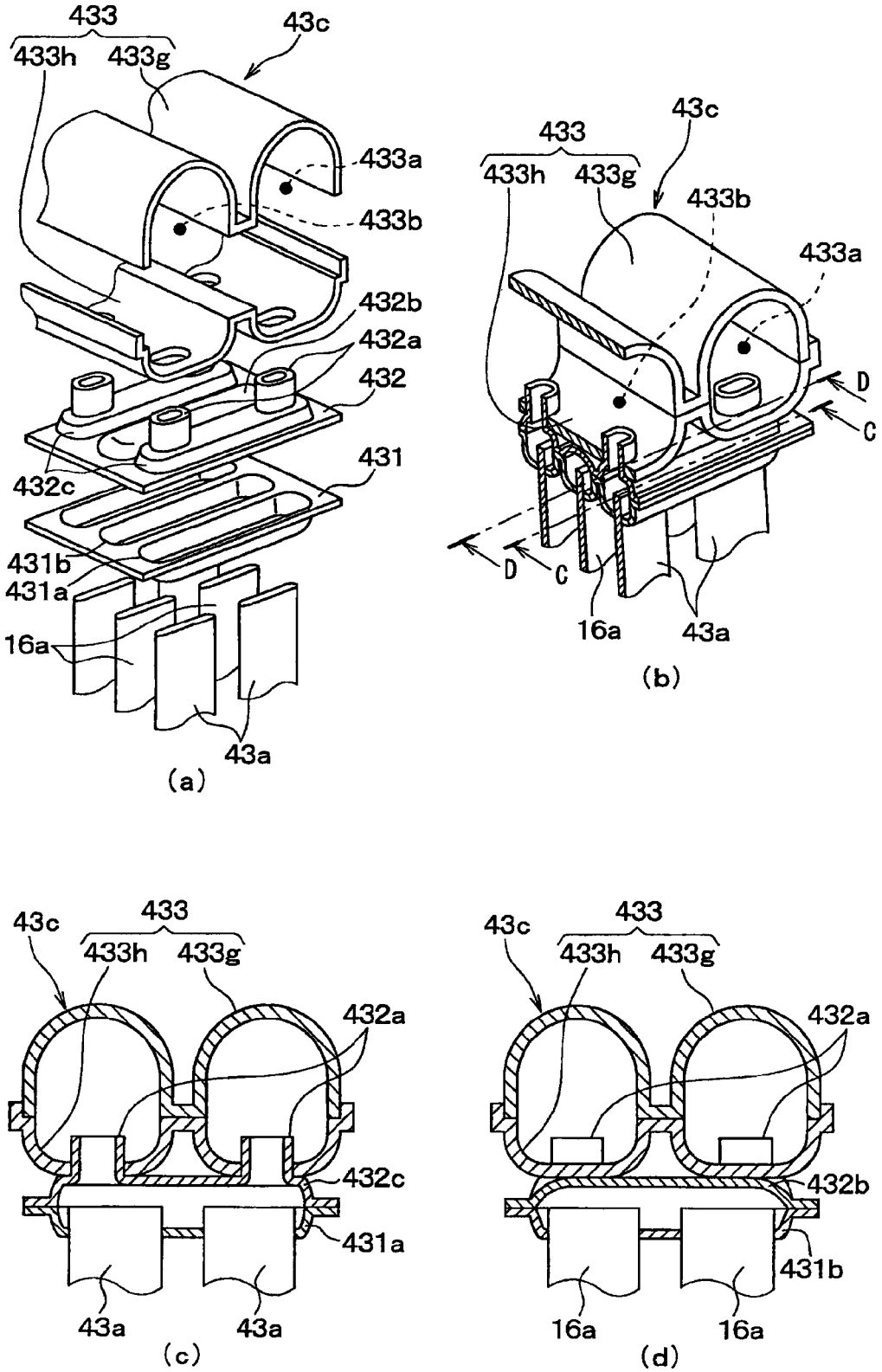
FIG. 12 (*a*) is an exploded view showing a portion of a heat exchanger according to a fourth embodiment, which corresponds to a portion B in FIG. 6, FIG. 12 (*b*) is a perspective view showing a portion of the heat exchanger corresponding to the portion in FIG. 12 (*a*), and showing a sectional surface of the portion of the heat exchanger according to the fourth embodiment, FIG. 12 (*c*) is a sectional view taken from a line C-C in FIG. 12 (*b*), and FIG. 12 (*d*) is a sectional view taken from a line D-D in FIG. 12 (*b*).

In a present embodiment, an example will be described, in which a configuration of a heat exchanger 70 is different from that in the second embodiment. A detailed configuration of the heat exchanger 70 of the present embodiment will be described referring to FIGS. 12(*a*) to (*d*). FIG. 12(*a*) is an exploded view of the heat exchanger 70 of the present embodiment, and shows an enlarged portion corresponding to the portion B of FIG. 6. FIG. 12(*b*) is a perspective view of a portion corresponding to the portion shown in FIG. 12(*a*), and shows a sectional surface of the portion. FIG. 12(*c*) is a sectional view taken along a line C-C of FIG. 12(*b*), and FIG. 12(*d*) is a sectional view taken along a line D-D of FIG. 12(*b*).

Basic configurations of a refrigerant tank part 16*c* and a cooling-medium tank part 43*c* are similar to each other. Hence, the cooling-medium tank part 43*c* will be described below, and a detailed description of the refrigerant tank part 16*c* is omitted similarly to the third embodiment.

In the second embodiment, the cooling-medium-collection tank forming member 433*c* and the cooling-medium-distribution tank forming member 433*d*, which are made from the tubular members, are adopted as the cooling-medium tank forming member 433. In the present embodiment, as shown in FIGS. 12(*a*) and (*b*), an upper tank forming member 433*g* and a lower tank forming member 433*h*, which are obtained by pressing of metal plates, are adopted as a cooling-medium tank forming member 433.

Both the upper tank forming member 433*g* and the lower tank forming member 433*h* are formed into two-peak shape (W-shape) viewed in longitudinal directions thereof. By joining these members 433*g* and 433*h* to each other in a drawn-cup state, a cooling-medium collection space 433*a* and a cooling-medium distribution space 433*b* are provided.

As shown in FIG. 12(*c*), the lower tank forming member 433*h* has communication holes communicating with second communication holes 432*a* that are provided in recessed parts 432*c* of the cooling-medium middle plate member 432. Through these communication holes, the cooling-medium tubes 43*a* communicate with the collection space 433*a* and the distribution space 433*b*.

As shown in FIG. 12(*d*), a refrigerant communication spaces are provided between recessed parts 432*b* of a cooling-medium middle plate member 432 and recessed parts 431*b* of a cooling-medium fixing plate member 431 which are provided at positions corresponding to refrigerant tubes 16*a*. Therefore, in the heat exchanger 70 of the present embodiment, refrigerant and coolant can be made to flow similarly to the flow shown in FIG. 8 of the first embodiment, and effects similar to those of the second embodiment can be obtained.

In the present embodiment, the cooling-medium tank forming member 433 of the cooling-medium tank part 43*c* is made from the two members 433*h*, 433*g* which are formed by pressing. The cooling-medium tank forming member 433 of the cooling-medium tank part 43*c* can be easily formed at low cost also by extrusion processing or drawing processing.

(Fifth Embodiment)

Figure 13:
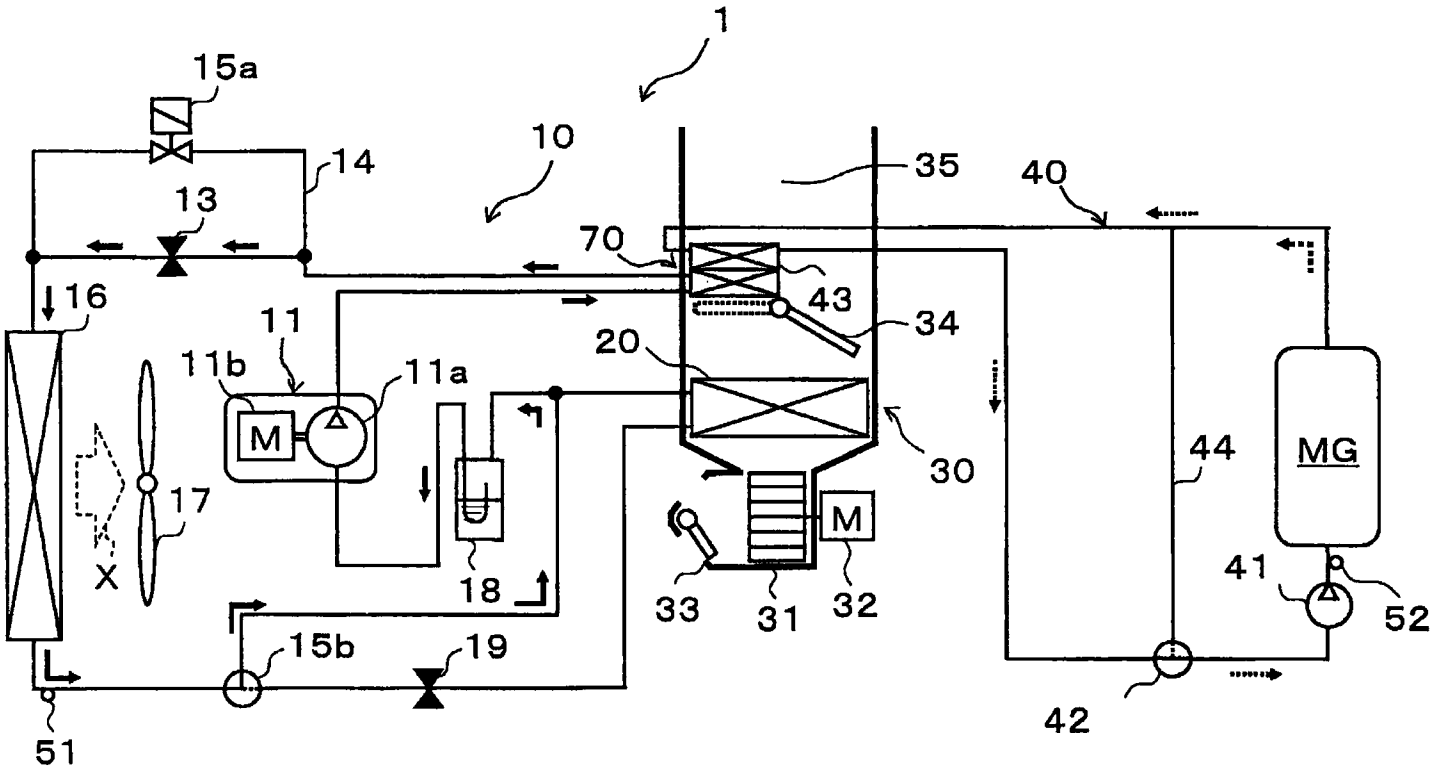
FIG. 13 is an entire configuration diagram showing a refrigerant flow passage in the waste-heat recovery operation of the heat pump cycle, according to the third embodiment.

In a present embodiment, as shown in an entire configuration diagram of FIG. 13, an example will be described, in which a configuration of a heat pump cycle 10 is different from that of the first embodiment. FIG. 13 is an entire configuration diagram showing, for example, a refrigerant flow passage during the waste-heat recovery operation in the present embodiment. A refrigerant flow in the heat pump cycle 10 is shown by solid arrows, and a coolant flow in a coolant circulation circuit 40 is shown by dash arrows in FIG. 13.

Specifically, in the present embodiment, the interior condenser 12 of the first embodiment is omitted. The combined heat exchanger 70 of the first embodiment is arranged in the casing 31 of the interior air-conditioning unit 30, and the exterior heat-exchange portion 16 of the heat exchanger 70 of the first embodiment functions as the interior condenser 12. Hereinafter, a portion of the heat exchanger 70 that functions as the interior condenser 12 is referred to as an interior condenser portion. In the present embodiment, an exterior heat-exchange portion 16 is a single heat exchanger in which refrigerant flowing therethrough exchanges heat with outside air blown by the blower fan 17. The other configurations are similar those of the first embodiment. In the present embodiment, the defrosting operation is not performed, but the other operations are similar to those of the first embodiment.

Therefore, during the waste-heat recovery operation of the present embodiment, air to be blown into the vehicle compartment is heated in the interior condenser portion of the heat exchanger 70 via heat exchange with refrigerant discharged from the compressor 11. The air that has been heated in the interior condenser portion can be further heated in the radiator portion 43 of the heat exchanger 70.

In the configuration of the heat pump cycle 10 of the present embodiment, the coolant can be made to exchange heat with the air that is to be blown into the vehicle compartment. Hence, even when an operation of the heat pump cycle 10 (specifically, the compressor 11) is stopped, heating of the vehicle compartment can be performed. Even when a heating capacity of the heat pump cycle 10 is low due to a low temperature of refrigerant discharged from the compressor 11, the heating of the vehicle compartment can be performed.

The heat exchangers 70 described in the second to fourth embodiments may be used for the heat pump cycle 10 of the present embodiment.

(Other Embodiments)

The invention is not limited to the above-described embodiments, and can be modified variously as follows without departing from the scope of the invention.

(1) In the above-described first embodiment, as shown in FIG. 7, an example is described, in which the cooling-medium communication spaces are provided in the refrigerant tank part 16*c*, and the refrigerant communication spaces are provided in the cooling-medium tank part 43*c*. However, it is concerned that pressure loss is generated in the coolant or the refrigerant in such communication spaces. Thus, it is preferable that volumes of the communication spaces are increased as large as possible.

Figure 14:
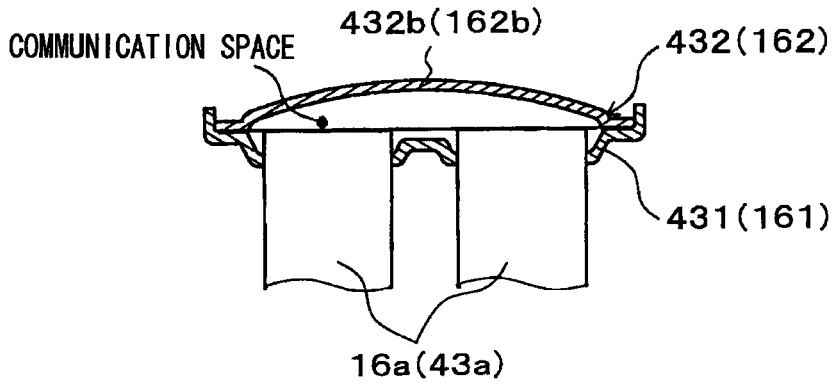
FIG. 14 (*a*) is a view showing a heat exchanger according to other embodiment, which corresponds to the sectional view taken from the line A-A in FIG. 5, and FIG. 14 (*b*) is a view showing a heat exchanger according to other embodiment, which corresponds to the sectional view taken from the line A-A in FIG. 5.
Figure 14:
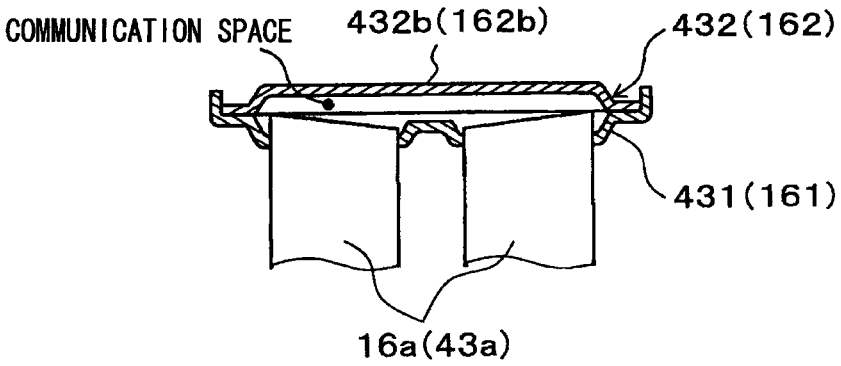

For example, as shown in FIG. 14(*a*), the recessed part 432*b* (162*b*) of the middle plate member 432 (162) may be formed into a shape, in which a depth of the recessed part 432*b* (162*b*) is gradually increased from both sides to a center portion of the middle plate member 432 (162) in an arrangement direction of the tubes 16*a* (43*a*) (i.e., the outside-air flow direction X).

Additionally, as shown in FIG. 14(*b*), the tubes 16*a* (43*a*) may be formed into a shape, in which lengths of the tubes 16*a* (43*a*) in their longitudinal direction gradually become short from both sides to the center portion of the middle plate member 432 (162) in the arrangement direction of the tubes 16*a* (43*a*). The middle plate member 432 (162) shown in FIG. 14(*a*) and the tubes 16*a* (43*a*) shown in FIG. 14(*b*) may be adopted together.

(2) In the above-described first embodiment, an example is described, in which the refrigerant of the heat pump cycle 10 is adopted as the first fluid, the coolant of the coolant circulation circuit 40 is adopted as the second fluid, and outside air blown by the blower fan 17 is adopted as the third fluid. However, the first to third fluids are not limited to these. For example, air to be blown into the vehicle compartment may be adopted as the third fluid as in the third embodiment.

For example, the first fluid may be high-pressure side refrigerant or low-pressure side refrigerant in the heat pump cycle 10.

For example, a coolant, which cools an electric device or the like such as an inverter supplying electric power to the engine and the vehicle-running electric motor MG, may be adopted as the second fluid. Moreover, cooling oil may be also adopted as the second fluid, and the second heat-exchange portion may function as an oil cooler. Furthermore, heat storage material, cold storage material or the like may be adopted as the second fluid.

When the heat pump cycle 10 having the heat exchanger 70 of the invention is used for a stationary air conditioner, a cold storage chamber, a cooling/heating device for a vending machine and the like, a coolant may be adopted as the second fluid, which cools an engine used as a drive source of a compressor of the heat pump cycle 10, an electric motor, other electric devices or the like.

Furthermore, in the above-described embodiments, an example is described, in which the heat exchanger 70 of the invention is used for a heat pump cycle (refrigeration cycle), but an application of the heat exchanger 70 of the invention is not limited to this. In other words, the heat exchanger 70 is widely available for, for example, a device in which heat exchange is performed among three fluids.

For example, the heat exchanger 70 can be used as a heat exchanger utilized for a vehicle cooling system. The first fluid may be a heat medium that absorbs heat of a first in-vehicle device that generates heat in its operation state. The second fluid may be a heat medium that absorbs heat of a second in-vehicle device that generates heat in its operation state, and the third fluid may be exterior air.

More specifically, when the heat exchanger 70 is used for a hybrid vehicle, the first in-vehicle device may be an engine EG, the first fluid may be a coolant of the engine EG. The second in-vehicle device may be a vehicle-running electric motor, and the second fluid may be a coolant of the vehicle-running electric motor.

Heat amounts generated from these in-vehicle devices change respectively depending on a running state (running load) of the vehicle. Thus, a temperature of the coolant of the engine EG and a temperature of the coolant of the vehicle-running electric motor also change depending on the running state of the vehicle. Hence, in this case, a generated heat of an in-vehicle device having a high heat-generation capacity can be radiated not only to air, but also to an in-vehicle device having a low heat-generation capacity.

(3) In the above-described embodiments, an example is described, in which the refrigerant tubes 16*a* of the exterior heat-exchange portion 16, the cooling-medium tubes 43*a* of the radiator portion 43 and the outer fins 50 are made of aluminum alloy (metal), and are joined with each other by brazing. However, the outer fins 50 may be made of other material (e.g., carbon nanotube) superior in heat conductivity, and may be joined to the tubes 16*a*, 43*a* by a joining method such as adhesion.

(4) In the above-described embodiments, an example is described, in which the electric three-way valve 42 is adopted as the circuit switching device that switches the cooling-medium circuit of the coolant circulation circuit 40, but the circuit switching device is not limited to this. For example, a thermostat valve may be adopted. The thermostat valve is a valve sensitive to a temperature of the cooling medium, and its valve body is displaced by using a thermosensitive wax (temperature-sensitive member) that changes its volume depending on a temperature. Thus, the thermostat valve has an automatic mechanism that opens or closes a cooling-medium passage by displacing the valve body with the thermosensitive wax. Therefore, by adopting the thermostat valve, the coolant temperature sensor 52 can be omitted.

(5) In the above-described embodiments, an example is described, in which the general fluorocarbon refrigerant is adopted as the refrigerant, but a kind of the refrigerant is not limited to this. For example, a natural refrigerant such as carbon dioxide or a hydrocarbon series refrigerant may be adopted. Moreover, the heat pump cycle 10 may be a supercritical refrigeration cycle in which a pressure of refrigerant discharged from the compressor 11 is equal to or higher than a critical pressure of the refrigerant.

What is claimed is:

1. A heat exchanger comprising:

a first heat-exchange portion including a plurality of first tubes through which a first fluid flows to exchange heat with a third fluid flowing around the first tubes, and a first tank part extending in a lamination direction of the first tubes to collect the first fluid from the first tubes and to distribute the first fluid to the first tubes;

a second heat-exchange portion including a plurality of second tubes through which a second fluid flows to exchange heat with the third fluid flowing around the second tubes, and a second tank part extending in a lamination direction of the second tubes to collect the second fluid from the second tubes and to distribute the second fluid to the second tubes, wherein at least one of the first tubes is arranged between the second tubes, at least one of the second tubes is arranged between the first tubes, the first tubes and the second tubes define therebetween spaces that include third fluid passages through which the third fluid flows, the third fluid passages accommodate therein outer fins that are capable of promoting the heat exchanges performed in the first and second heat-exchange portions and are capable of transferring heat between the first fluid flowing through the first tubes and the second fluid flowing through the second tubes, both the first tubes and the second tubes are fixed to the first tank part, both the first tubes and the second tubes are fixed to the second tank part, the first tank part includes:

a first fixing plate member to which at least one of the plurality of first tubes or the plurality of second tubes is fixed;

a first middle plate member fixed to the first fixing plate member; and a first tank forming member that is fixed to the first fixing plate member or the first middle plate member, and has therein a space into which the first fluid is collected or from which the first fluid is distributed, the second tank part includes:

a second fixing plate member to which at least one of the plurality of first tubes or the plurality of second tubes is fixed;

a second middle plate member fixed to the second fixing plate member; and a second tank forming member fixed to the second fixing plate member or the second middle plate member, and has therein a space into which the second fluid is collected or from which the second fluid is distributed, the first middle plate member has first communication holes through which the first tubes communicate with the space provided inside the first tank forming member, the second middle plate member has second communication holes through which the second tubes communicate with the space provided inside the second tank forming member, the first tubes and the second tubes lined in the lamination direction are arranged in a plurality of rows with respect to a flow direction of the third fluid flowing through the third fluid passages, the first fixing plate member and the first middle plate member define therebetween first communication spaces through which the second tubes adjacent to each other with respect to the flow direction of the third fluid communicate with each other, and the second fixing plate member and the second middle plate member define therebetween second communication spaces through which the first tubes adjacent to each other with respect to the flow direction of the third fluid communicate with each other.

2. The heat exchanger according to claim 1, wherein the first tubes extend through the first communication holes to protrude into the space provided inside the first tank forming member, and the second tubes extend through the second communication holes to protrude into the space provided inside the second tank forming member.

3. The heat exchanger according to claim 1, wherein the first and second tubes are fixed to the first and second fixing plate members by brazing.

4. The heat exchanger according to claim 1, wherein the first fixing plate member is fixed to the first tank forming member by crimping, and the second fixing plate member is fixed to the second tank forming member by crimping.

5. The heat exchanger according to claim 1, being used as an evaporator of a vapor-compression refrigeration cycle, in which refrigerant evaporates, wherein the first fluid is the refrigerant of the refrigeration cycle, the second fluid is heat medium having absorbed heat of an external heat source, and the third fluid is air.

6. The heat exchanger according to claim 1, being used as a radiator of a vapor-compression refrigeration cycle, in which refrigerant radiates heat, wherein the first fluid is the refrigerant of the refrigeration cycle, the second fluid is heat medium having absorbed heat of an external heat source, and the third fluid is air.

7. The heat exchanger according to claim 1, being used for a vehicle cooling system, wherein the first fluid is a heat medium having absorbed heat of a first in-vehicle device that generates heat in its operation state, the second fluid is a heat medium having absorbed heat of a second in-vehicle device that generates heat in its operation state, and the third fluid is air.

* * * * *